US008512005B2

(12) United States Patent
Tanaka

(10) Patent No.: US 8,512,005 B2
(45) Date of Patent: Aug. 20, 2013

(54) ION PUMP SYSTEM AND ELECTROMAGNETIC FIELD GENERATOR

(75) Inventor: Shukichi Tanaka, Koganei (JP)

(73) Assignee: National Institute Of Information And Communications Technology, Koganei-shi, Tokyo (JP)

( * ) Notice: Subject to any disclaimer, the term of this patent is extended or adjusted under 35 U.S.C. 154(b) by 465 days.

(21) Appl. No.: 12/867,492

(22) PCT Filed: Feb. 13, 2009

(86) PCT No.: PCT/JP2009/000571
§ 371 (c)(1),
(2), (4) Date: Aug. 13, 2010

(87) PCT Pub. No.: WO2009/101814
PCT Pub. Date: Aug. 20, 2009

(65) Prior Publication Data

US 2010/0310383 A1 Dec. 9, 2010

(30) Foreign Application Priority Data

Feb. 14, 2008 (JP) ..... 2008-033222

(51) Int. Cl.
*F04B 37/02* (2006.01)
*F04F 99/00* (2009.01)

(52) U.S. Cl.
USPC ..... 417/48; 417/49; 417/50

(58) Field of Classification Search
USPC ..... 417/48, 49, 50; 414/217; 118/719
See application file for complete search history.

(56) References Cited

U.S. PATENT DOCUMENTS

| | | | | | |
|---|---|---|---|---|---|
| 2,972,690 | A | * | 2/1961 | McCoubrey | 313/7 |
| 3,022,933 | A | * | 2/1962 | Ellis | 315/111.01 |
| 3,091,717 | A | * | 5/1963 | Lloyd et al. | 417/49 |
| 3,141,986 | A | * | 7/1964 | Lloyd et al. | 313/7 |
| 3,159,332 | A | * | 12/1964 | Rutherford | 417/49 |
| 3,198,422 | A | * | 8/1965 | Gerhard | 417/49 |
| 3,228,590 | A | * | 1/1966 | Kearns et al. | 417/49 |
| 3,258,194 | A | * | 6/1966 | Lloyd | 313/153 |
| 3,356,287 | A | * | 12/1967 | Winters | 417/49 |
| 3,542,488 | A | * | 11/1970 | Hall | 417/49 |
| 3,827,829 | A | * | 8/1974 | Tom | 417/49 |
| 4,274,022 | A | * | 6/1981 | Elsel | 310/62 |
| 4,389,166 | A | * | 6/1983 | Harvey et al. | 417/234 |

(Continued)

FOREIGN PATENT DOCUMENTS

| | | |
|---|---|---|
| JP | 35-16136 B1 | 10/1960 |
| JP | 41-2510 B1 | 2/1966 |

(Continued)

*Primary Examiner* — Charles Freay
*Assistant Examiner* — Ryan Gatzemeyer
(74) *Attorney, Agent, or Firm* — Pyprus Pte Ltd

(57) ABSTRACT

It is an object of the present invention to provide an ion pump system etc. having a high air-exhausting capacity and vacuum-maintaining capacity and capable of adjusting drive modes suitable for the uses thereof. The subject problem is solved by an ion pump system (7) comprising a casing (1), a first electrode group (2*a*,2*b*) provided in the casing (1), a second electrode group (3*a*,3*b*) provided on the outer periphery of the first electrode group (2*a*,2*b*), and outer magnets (4) for providing a magnetic field in the casing, wherein the first electrode group (2*a*,2*b*) and the second electrode group (3*a*, 3*b*) are constituted as a plurality of layers alternately disposed around the center axis (11) of the casing (1).

11 Claims, 21 Drawing Sheets

(56) References Cited

U.S. PATENT DOCUMENTS

| | | | | |
|---|---|---|---|---|
| 4,594,054 | A * | 6/1986 | Ishimaru et al. | 417/49 |
| 5,442,183 | A * | 8/1995 | Matsui et al. | 250/441.11 |
| 5,632,876 | A * | 5/1997 | Zanzucchi et al. | 204/600 |
| 5,899,666 | A * | 5/1999 | Chung et al. | 417/49 |
| 6,004,104 | A * | 12/1999 | Rutherford | 417/49 |
| 6,443,704 | B1 * | 9/2002 | Darabi et al. | 417/50 |
| 6,616,417 | B2 * | 9/2003 | Shen | 417/50 |
| 7,261,521 | B2 * | 8/2007 | Yagoobi | 417/48 |
| 7,517,440 | B2 * | 4/2009 | Anex et al. | 204/450 |
| 7,635,943 | B2 * | 12/2009 | Kamio et al. | 313/7 |
| 8,192,604 | B2 * | 6/2012 | Anex et al. | 204/600 |
| 8,246,314 | B2 * | 8/2012 | Tanaka | 417/48 |
| 8,328,526 | B2 * | 12/2012 | Tanaka | 417/48 |
| 2002/0122728 | A1 * | 9/2002 | Darabi et al. | 417/48 |
| 2004/0120826 | A1 * | 6/2004 | Perkins et al. | 417/48 |
| 2005/0053472 | A1 * | 3/2005 | Yagoobi | 417/48 |
| 2006/0078433 | A1 * | 4/2006 | Seino et al. | 417/50 |
| 2007/0280834 | A1 * | 12/2007 | Bonmassar et al. | 417/49 |
| 2009/0196765 | A1 * | 8/2009 | Dyer et al. | 417/48 |
| 2010/0098556 | A1 * | 4/2010 | Tanaka | 417/49 |
| 2010/0143159 | A1 * | 6/2010 | Tanaka | 417/49 |
| 2010/0237243 | A1 * | 9/2010 | Noji et al. | 250/310 |
| 2010/0310383 | A1 * | 12/2010 | Tanaka | 417/48 |
| 2011/0103975 | A1 * | 5/2011 | Rutherford et al. | 417/49 |
| 2012/0032079 | A1 * | 2/2012 | Nakasuji et al. | 250/310 |

FOREIGN PATENT DOCUMENTS

| | | | |
|---|---|---|---|
| JP | 51-53612 | A | 5/1976 |
| JP | 07-312202 | A | 11/1995 |
| JP | 09-027294 | A | 1/1997 |
| JP | 2001-332209 | A | 11/2001 |

* cited by examiner

ION PUMP SYSTEM AND ELECTROMAGNETIC FIELD GENERATOR

FIELD OF INVENTION

The present invention relates to an ion pump system etc. having a plurality of electrode layers. For example, the present invention relates to a lightweight and low power consumption multimode ion pump system etc. having operational modes according to loads.

DESCRIPTION OF THE RELATED ART

With the developments in nanotechnology and ultraprecise measuring technique, ultrahigh vacuum technology has been emphasized. Semiconductor surfaces are vulnerable to pollution from gas molecules. On the other hand, clean semiconductor surfaces can be maintained by maintaining semiconductors in ultrahigh vacuum under around $10^{-7}$ Pa. And, in order to maintain ultrahigh vacuum, pumps such as an ion pump are used.

As for conventional ion pumps, as shown in FIGS. 4(A) and 4(B) in JPA H9-27294, tabular permanent magnets are arranged parallel to each other across a cuboid container. This makes a magnetic field unidirectional, making it impossible to make effective use of space in an ion pump.

In order to solve such a problem, claim 1 of JPA H9-27294 (Patent Document 1 below) discloses "an ion pump comprising a cylindrical positive electrode and a cylindrical negative electrode in its circumference both arranged concentrically in a cylindrical casing, characterized in that a radial electric field generation means among each cylindrical surface of the said cylindrical negative electrode, the cylindrical positive electrode and the casing, and a magnetic field generation means parallel to the axis of the said cylindrical positive electrode and the cylindrical negative electrode arc provided in the cylindrical casing".

Also, claim 1 of Patent Document 2: JPA 2001-332209 (Patent Document 2 below) discloses "a sputter ion pump comprising an anode electrode and a cathode electrode arranged in a vacuum chamber, wherein high voltage is applied between the anode electrode and cathode electrode so that electrons are spirally moved by means of a magnetic field, residual gas molecules are collided with electrons that are spirally moving and are ionized, and the ionized molecules sputter the cathode electrode to adsorb onto the surfaces of the anode electrode or the like, thereby performing an evacuation, characterized in that the cylindrical section of the vacuum chamber wall is formed to have a convex or concave cross-sectional profile, permanent magnets each having the same shape and character are located in the direction of the same magnetic pole in each concave portion outside the convex or concave cross-sectional profile, anode electrodes each of which is cylindrical are located apart from the vacuum chamber wall in each concave portion inside the convex or concave cross-sectional profile, the cylindrical portion of the vacuum chamber wall is constituted as a cathode electrode, a cylindrical magnetic shield member equipped with an exhaust hole circumferentially is arranged concentrically with the plurality of permanent magnets and the anode electrodes, and the plurality of permanent magnets and the anode electrodes are arranged at equal intervals axially opposite one another".

However, such ion pumps need to use many insulators such as ceramics in order to obtain insulation between electrodes. For this reason, there is a problem that gases are emitted from ceramics etc., lowering a degree of vacuum. There is also a problem that such ion pumps do not have enough intensity.

Furthermore, such ion pumps are large and heavy, and their power consumption is also large. Therefore, there is a problem that once the conventional ion pumps are located they cannot be moved easily. Moreover, there is a problem of low connectivity with other devices.

Moreover, it has been hoped to develop a small ion pump having a high air-exhausting capacity and vacuum-maintaining capacity.

Moreover, it has been hoped to develop an ion pump capable of adjusting drive modes suitable for the uses thereof.

Furthermore, there is a problem that the ion pumps as described above, in order to make space therein insusceptible to electromagnetic field, require special magnetic field shielding structure for installation, resulting in high cost. For this reason, it has been hoped to develop an ion pump system capable of making space internally insusceptible to electromagnetic field at low cost. The uses of space insusceptible to electromagnetic field include the paths of beams or particle beams output from an electron microscope or an electron beam exposure device, for example. Beams or particle beams are formed of electrons, protons, or charged particles, for example.

Furthermore, the space made inside an ion pump insusceptible to electromagnetic field can be reserved as a passage of fluid (gas or liquid), it is possible to make electromagnetic energy act on the materials included in fluid in a passage. Under the circumstances, it has been hoped to develop an ion pump or an electromagnetic field generator capable of realizing the generation of such an electromagnetic field. Meanwhile, for such realization, there is a need to prevent leakage of fluid. For this reason, it has bee hoped to develop an ion pump or an electromagnetic field generator having high connectivity with other devices. If it is possible to make electromagnetic energy act on the materials included in fluid in a passage, it is expected to realize ionization activation (ionization) of materials.

Patent Document 1: JPA F19-27294

Patent Document 2: JPA 2001-332209

SUMMARY OF THE INVENTION

Problems to be Solved by the Invention

It is an object of the present invention to provide a small ion pump system.

It is another object of the present invention to provide an ion pump system having a high air-exhausting capacity and vacuum-maintaining capacity.

It is still another object of the present invention to provide an ion pump system capable of adjusting drive modes suitable for the uses thereof.

It is still another object of the present invention to provide an ion pump system having high connectivity with other devices.

It is still another object of the present invention to provide an ion pump system capable of making room internally insusceptible to electromagnetic fields at low cost. Furthermore, it is still another object of the present invention to provide an electromagnetic field generator wherein space insusceptible to electromagnetic fields is a fluid passage.

Means for Solving the Problems

The present invention is basically based on knowledge that each pump part, which is configured by dividing the inside of an ion pump into a plurality of layers, can be driven independently. According to the present invention, a plurality of ion pumps can be configured inside an ion pump system, thereby obtaining high vacuum even though the system is small. According to the present invention, only appropriate pump parts can be driven depending on targets, thereby obtaining vacuum extremely effectively.

The first aspect of the present invention relates to an ion pump system having two pump parts. The ion pump system comprises a casing (1), a first electrode group (2*a*, 2*b*), a second electrode group (3*a*, 3*b*), outer magnets (4), and inner magnets (5). The casing (1) comprises a connecting part (6).

The first electrode group (2*a*, 2*b*) is provided in the casing (1). The second electrode group (3*a*, 3*b*) is provided in the casing (1). And the first electrode group and the second electrode group differ in polarity. Namely, one is a positive electrode and the other is negative electrode. The outer magnets (4) are magnets for applying a magnetic field within the casing (1). The outer magnets (4) may be provided either inside or outside the casing (1) as far as they can apply a magnetic field within the casing (1). The inner magnets (5) are magnets provided within the casing (1). The connecting part (6) is a part for connecting the casing (1) or an ion pump system (7) with other devices.

In the first aspect of the present invention, a casing (1), a first electrode group (2*a*, 2*b*), a second electrode group (3*a*, 3*b*) and inner magnets (5) are provided outwardly from the center of the casing in the following order, namely:

inner magnets (5) provided along a central axis (11) of a casing (1) or axisymmetrically with respect to the central axis (11);

a first electrode (2*a*) of a first electrode group provided at the innermost of the first electrode group;

a first electrode (3*a*) of a second electrode group provided at the innermost of the second electrode group;

a second electrode (3*b*) of a second electrode group provided in the second position from the inside among the second electrode group;

a second electrode (2*b*) of a first electrode group provided in the second position from the inside among the first electrode group; and outer magnets (4).

In this way, an ion pump system of the present invention has a plurality of electrodes therein, thereby increasing ion trap fields and as a result improving the efficiency of an ion pump system. Furthermore, as described later, an ion pump system of the present invention can drive an ion pump effectively depending on targets by driving the ion pump divided into a plurality of pump parts.

A preferred embodiment of the first aspect of the present invention comprises a first drive means (12) and a second drive means (13). The first drive means (12) drives a first electrode (2*a*) of a first electrode group and a first electrode (3*a*) of a second electrode group. The second drive means (13) drives a second electrode (3*b*) of a second electrode group and a second electrode (2*b*) of a first electrode group.

The first drive means (12) drives a first pump part comprising an inner magnet (5), a first electrode (2*a*) of a first electrode group and a first electrode (3*a*) of a second electrode group. Similarly, the second drive means (13) drives a second pump part comprising a second electrode (3*b*) of a second electrode group, a second electrode (2*b*) of a first electrode group, and outer magnets (4).

The ion pump system (7) of this embodiment can drive a first pump part and a second pump part independently by driving a first drive means (12) and a second drive means (13) independently.

A preferred embodiment of the first aspect of the present invention relates to an ion pump system as described in any of the above, wherein a first electrode (3*a*) of a second electrode group and a second electrode (3*b*) of a second electrode group are an inner surface and an outer surface of one cylindrical electrode. This use of one cylindrical electrode with respect to electrodes having the same polarity makes it possible to downsize an ion pump system.

A preferred embodiment of the first aspect of the present invention relates to an ion pump system as described in any of the above, wherein outer magnets (4) comprise a plurality of cylindrical permanent magnets arranged at intervals in the longitudinal direction of a casing (1).

This use of cylindrical permanent magnets makes it possible to effectively generate a magnetic field inside a casing (1).

A preferred embodiment of the first aspect of the present invention relates an ion pump system as described in any of the above, wherein the ion pump system further comprises a movement device (14) for moving a plurality of cylindrical permanent magnets toward the longitudinal direction of a casing (1). This movement mechanism (14) that can change the magnetic field concentration field makes it possible to prevent degradation of an ion pump system as well as improve the efficiency of an ion pump system. The movement mechanism (14) may be such that it allows manual movement of magnets.

A preferred embodiment of the first aspect of the present invention relates to an ion pump system, wherein cylindrical permanent magnets are removable from a casing (1). This ability to remove cylindrical permanent magnets makes it possible to improve productivity of an ion pump system (7) and makes the maintenance easier.

In a preferred embodiment of the first aspect of the present invention, pluralities of cylindrical permanent magnets are configured so that the surface of neighboring cylindrical permanent magnets may have the same polarity. And an ion pump system of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified.

This arrangement of further magnets between magnets makes it possible to strengthen the magnetic field formed inside a casing (1). This makes it possible to improve the efficiency of an ion pump system.

The second aspect of the present invention relates to an ion pump system having three pump parts. The ion pump system basically employs the same configuration as the first aspect of the present invention. The ion pump system comprises a casing (1), a first electrode group (2*a*, 2*b*, 2*c*), a second electrode group (3*a*, 3*b*, 3*c*), outer magnets (4) and inner magnets (5*a*, 5*b*). The casing (1) comprises a connecting part (6) for connecting an ion pump system (7) with other devices.

A casing (1), a first electrode group (2*a*, 2*b*,2*c*), a second electrode group (3*a*, 3*b*, 3*c*) and inner magnets (5*a*, 5*b*) are provided outwardly from the center of the casing in the following order, namely:

an inner magnet (5*a*) provided along a central axis (11) of a casing (1) or axisymmetrically with respect to the central axis (11);

a first electrode (2*a*) of a first electrode group provided at the innermost of the first electrode group;

a first electrode (3*a*) of a second electrode group provided at the innermost of the second electrode group;

a second electrode (3*b*) of a second electrode group provided in the second position from the inside among the second electrode group;

a second electrode (2*b*) of a first electrode group provided in the second position from the inside among the first electrode group;

a cylindrical inner magnet (5*b*);

a third electrode (2*c*) of a first electrode group provided in the third position from the inside among the first electrode group;

a third electrode (3*c*) of a second electrode group provided in the third position from the inside among the second electrode group; and outer magnets (4).

A preferred embodiment of the second aspect of the present invention comprises first through third drive means (12, 13, 15). The first drive means (12) drives a first electrode (2*a*) of a first electrode group and a first electrode (3*a*) of a second electrode group. The second drive means (13) drives a second electrode (36) of a second electrode group and a second electrode (2*b*) of a first electrode group. The third drive means (15) drives a third electrode (2*c*) of a first electrode group and a third electrode (3*c*) of a second electrode group.

The first drive means (12) drives a first pump part comprising an inner magnet (5*a*), a first electrode (2*a*) of a first electrode group and a first electrode (3*a*) of a second electrode group. The second drive means (13) drives a second pump part comprising a second electrode (3*b*) of a second electrode group, a second electrode (2*b*) of a first electrode group, and a cylindrical inner magnet (5*b*). Similarly, the third drive means (15) drives a third pump part comprising a third electrode (2*c*) of a first electrode group, a third electrode (3*c*) of a second electrode group and outer magnets (4).

Therefore, the ion pump system (7) of this embodiment can drive a first pump part, a second pump part and a third pump part independently by driving a first drive means (12), a second drive means (13) and a third drive means (15) independently.

A preferred embodiment of the second aspect of the present invention relates to an ion pump system as described in any of the above, wherein a first electrode (3*a*) of a second electrode group and a second electrode (3*b*) of a second electrode group are an inner surface and an outer surface of one cylindrical electrode.

A preferred embodiment of the second aspect of the present invention relates to an ion pump system as described in any of the above, wherein outer magnets (4) comprise a plurality of cylindrical permanent magnets arranged at intervals in the longitudinal direction of a casing (1).

A preferred embodiment of the second aspect of the present invention relates an ion pump system as described in any of the above, wherein the ion pump system further comprises a movement mechanism (14) for moving a plurality of cylindrical permanent magnets toward the longitudinal direction of a easing (1). The movement mechanism (14) may be such that it allows manual movement of magnets.

A preferred embodiment of the second aspect of the present invention relates to an ion pump system, wherein cylindrical permanent magnets are removable from a casing (1). This ability to remove cylindrical permanent magnets makes it possible to improve productivity of an ion pump system and makes the maintenance easier.

In a preferred embodiment of the second aspect of the present invention, pluralities of cylindrical permanent magnets are configured so that the surface of neighboring cylindrical permanent magnets may have the same polarity. And an ion pump system (7) of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified.

The third aspect of the present invention relates to an ion pump system having four pump parts. The ion pump system basically employs the same configuration as the first aspect of the present invention. The ion pump system comprises a casing (1), a first electrode group (2*a*, 2*b*, 2*c*, 2*d*), a second electrode group (3*a*, 3*b*, 3*c*, 3*d*), outer magnets (4) and inner magnets (5*a*, 5*b*). The casing (1) comprises a connecting part (6) for connecting an ion pump system (7) with other devices.

A casing (1), a first electrode group (2*a*, 2*b*, 2*c*, 2*d*), a second electrode group (3*a*, 3*b*, 3*c*, 3*d*) and inner magnets (5*a*, 5*b*) are provided outwardly from the center of the casing in the following order, namely:

an inner magnet (5*a*) provided along a central axis (11) of a casing (1) or axisymmetrically with respect to the central axis (11);

a first electrode (2*a*) of a first electrode group provided at the innermost of the first electrode group;

a first electrode (3*a*) of a second electrode group provided at the innermost of the second electrode group;

a second electrode (3*b*) of a second electrode group provided in the second position from the inside among the second electrode group;

a second electrode (2*b*) of a first electrode group provided in the second position from the inside among the first electrode group;

a cylindrical inner magnet (5*b*) a third electrode (2*c*) of a first electrode group provided in the third position from the inside among the first electrode group;

a third electrode (3*c*) of a second electrode group provided in the third position from the inside among the second electrode group;

a fourth electrode (3*d*) of a second electrode group provided in the fourth position from the inside among the second electrode group;

a fourth electrode (2*d*) of a first electrode group provided in the fourth position from the inside among the first electrode group; and outer magnets (4).

A preferred embodiment of the third aspect of the present invention comprises first through fourth drive means (12, 13, 15, 16). The first drive means (12) drives a first electrode (2*a*) of a first electrode group and a first electrode (3*a*) of a second electrode group. The second drive means (13) drives a second electrode (3*b*) of a second electrode group and a second electrode (2*b*) of a first electrode group. The third drive means (15) drives a third electrode (2*c*) of a first electrode group and a third electrode (3*c*) of a second electrode group. The fourth drive means (16) drives a fourth electrode (3*d*) of a second electrode group and a fourth electrode (2*d*) of a first electrode group.

The first drive means (12) drives a first pump part comprising an inner magnet (5*a*), a first electrode (2*a*) of a first electrode group and a first electrode (3*a*) of a second electrode group. The second drive means (13) drives a second pump part comprising a second electrode (3*b*) of a second electrode group, a second electrode (2*b*) of a first electrode group, and a cylindrical inner magnet (5*b*). The third drive means (15) drives a third pump part comprising a third electrode (2*c*) of a first electrode group and a third electrode (3*c*) of a second electrode group. The third drive means (16) drives a fourth pump part comprising a fourth electrode (3*d*) of a second electrode group, a fourth electrode (2*d*) of a first electrode group and outer magnets (4).

Therefore, the ion pump system of this embodiment can drive a first pump part, a second pump part, a third pump part and a fourth pump part independently by driving a first drive means (12), a second drive means (13), a third drive means (15) and a fourth drive means (16) independently.

A preferred embodiment of the third aspect of the present invention relates to an ion pump system as described in any of the above, wherein outer magnets (4) comprise a plurality of cylindrical permanent magnets arranged at intervals in the longitudinal direction of a casing (1).

A preferred embodiment of the third aspect of the present invention relates an ion pump system as described in any of the above, wherein the ion pump system further comprises a movement mechanism (14) for moving a plurality of cylindrical permanent magnets toward the longitudinal direction of a casing (1). The movement mechanism (14) may be such that it allows manual movement of magnets.

A preferred embodiment of the third aspect of the present invention relates to an ion pump system, wherein cylindrical permanent magnets are removable from a casing (1). This ability to remove cylindrical permanent magnets makes it possible to improve productivity of an ion pump system and makes the maintenance easier.

In a preferred embodiment of the third aspect of the present invention, pluralities of cylindrical permanent magnets are configured so that the surface of neighboring cylindrical permanent magnets may have the same polarity. And an ion pump system (7) of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified.

The fourth aspect of the present invention relates to an ion pump system having a plurality of pump parts. The ion pump system basically can employ the same configuration as the first aspect of the present invention. The ion pump system comprises a casing, a first electrode group, a second electrode group, outer magnets and inner magnets. The casing comprises a connecting part for connecting an ion pump system with other devices.

The ion pump system has a casing, a first electrode group, a second electrode group and inner magnets, outwardly from the center of the casing in the following order, namely:

inner magnets provided along a central axis of a casing or axisymmetrically with respect to the central axis;

a first electrode aggregate part comprising electrodes included in a first electrode group and electrodes included in a second electrode group;

cylindrical inner magnets located at the innermost; a nth electrode aggregate part comprising electrodes included in a first electrode group and electrodes included in a second electrode group for each integer from 2 to n where n is an integer $\geqq 2$;

cylindrical inner magnets provided in the nth position from the inside; and outer magnets (4).

The first electrode aggregate part is arranged in the following order, namely: a first electrode of a first electrode group provided at the innermost of the first electrode group;

a first electrode of a second electrode group provided at the innermost of the second electrode group;

a second electrode of a second electrode group provided in the second position from the inside among the second electrode group; and a second electrode of a first electrode group provided in the second position from the inside among the first electrode group.

The second electrode aggregate parts are arranged in the following order, namely:

a certain electrode of a first electrode group;

a certain electrode of a second electrode group;

another certain electrode of a second electrode group; and another certain electrode of a first electrode group, in this order.

The nth electrode aggregate part has the following two patterns of configuration. The first configuration pattern of the nth electrode aggregate part is the following order, namely:

a certain electrode of a first electrode group;

a certain electrode of a second electrode group;

a certain electrode of a second electrode group; and a certain electrode of a first electrode group.

The second configuration pattern of the nth electrode aggregate part is the following order, namely:

a certain electrode of a first electrode group; and certain electrode of a second electrode group.

A preferred embodiment of the fourth aspect of the present invention relates to an ion pump system as described in any of the above, wherein outer magnets comprise a plurality of cylindrical permanent magnets arranged at intervals in the longitudinal direction of a casing.

A preferred embodiment of the fourth aspect of the present invention relates an ion pump system as described in any of the above, wherein the ion pump system further comprises a movement mechanism (14) for moving a plurality of cylindrical permanent magnets toward the longitudinal direction of a casing. The movement mechanism (14) may be such that it allows manual movement of magnets.

A preferred embodiment of the fourth aspect of the present invention relates to an ion pump system, wherein cylindrical permanent magnets are removable from a casing (1). This ability to remove cylindrical permanent magnets makes it possible to improve productivity of an ion pump system and makes the maintenance easier.

In a preferred embodiment of the fourth aspect of the present invention, a plurality of cylindrical permanent magnets are configured so that the surface of neighboring cylindrical permanent magnets may have the same polarity. And an ion pump system of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified.

The fifth aspect of the present invention relates to an ion pump system (7) comprising a cylindrical casing (1), a first cylindrical electrode (2*a*) provided inside the casing (1), a second cylindrical electrode (3*a*) provided inside the casing (1) and a magnet (4) for applying a magnetic field within the casing (1). The casing (1) comprises at least one connecting part (6) for connecting the system (7) with other devices. The first electrode (2*a*) and the second electrode (3*a*) have different polarity.

The outer peripheral surface of the first electrode (2*a*), the outer peripheral surface of the second electrode (3*a*) and the outer peripheal surface of the casing (1) are arranged outwardly from the center (1) of the casing in this order. A hollow space (30) is provided at the inner peripheral surface side of the first electrode (2*a*). The hollow space (3) is arranged along the central axis (11) of the casing (1). Thus, the hollow space (30) can be insusceptible to the influence of an electromagnetic field by an electrode or a magnet on the outer peripheral side.

In a preferred embodiment of the fifth aspect of the present invention, the inner peripheral surface of the first electrode (2*a*) forms a part of the outer peripheral surface of the hollow space (30).

In a preferred embodiment of the fifth aspect of the present invention, an ion pump system (7) further comprises an inner casing (32) and a fixed member (34). The inner casing (32) is arranged to be in the inner peripheral surface side of the casing (1). The fixed member (34) is a member for arranging and fixing the inner casing (32), the first electrode (2*a*), the second electrode (3*a*) and the casing (1) outwardly from the center of the casing (1) in this order. In this case, the hollow space (30) is arranged to be inside of the inner casing (32).

In a more preferred embodiment of the fifth aspect of the present invention, the inner casing (32) comprises an inner flange (36) arranged on the other side of the fixed member (34) as the connecting part (6) and standing toward the hollow space (30). This makes it easier to connect an ion pump system (7) with other devices. That is, this preferred embodiment has higher connectivity with other devices.

In a more preferred embodiment of the fifth aspect of the present invention, the casing (1) comprises an outer flange (38) standing toward the outside of the casing (1) as the connecting part (6). This makes it easier to connect an ion pump system (7) with other devices. That is, this preferred embodiment has higher connectivity with other devices.

The sixth aspect of the present invention is an ion pump system further comprising a third electrode (2*b*) arranged between the first electrode (2*a*) and the casing (1), a fourth electrode (3*b*) arranged between the third electrode (2*b*) and the second electrode (3*a*), and a cylindrical inner magnet (5) other than the magnet (4) arranged closer to the center of the casing (1) than the inner peripheral surface of the first electrode (2*a*) for applying a magnetic field within the casing (1). Namely, an ion pump system (7) according to this aspect is additionally provided with a pair of electrodes and a magnet to an ion pump system (7) according to the fifth aspect as described above. Namely the ion pump of this aspect comprises two ion pump parts. The first electrode (2*a*) and the third electrode (2*b*) mutually have the same polarity, and the second electrode (2*b*) and the fourth electrode (3*b*) mutually have the same polarity. Even in this case, a hollow space (30) can be provided. In order to introduce fluid from a hollow space (30), porosity is provided in the space between neighboring two electrodes having different polarities.

In a preferred embodiment of the sixth aspect of the present invention, the second electrode (3*a*) and the fourth electrode (3*b*) are the inner surface and the outer surface of one cylindrical electrode. This use of one cylindrical electrode with respect to electrodes having the same polarity makes it possible to downsize an ion pump system.

The seventh aspect of the present invention is an electromagnetic field generator comprising a cylindrical casing (1), a first cylindrical electrode (2*a*) provided inside the casing (1), a second cylindrical electrode (3*a*) provided inside the casing (1), and outer magnets for applying a magnetic field within the casing. The casing (1) comprises at least one connecting part (6) for connecting the electromagnetic generator with other devices. Furthermore, the first electrode and the second electrode have different polarities. The outer peripheral surface of the first electrode (2*a*), the outer peripheral surface of the second electrode (3*a*) and the outer peripheral surface of the casing (1) are arranged outwardly from the center of the casing in this order. And a passage through which materials provided from other devices flow is formed on the inner peripheral surface side of the first electrode along the central axis (11) of the casing. According to this aspect, space insusceptible to electromagnetic fields can be made a fluid passage. Fluid is not limited to gas but may be liquid or the like. In case liquid is let flow through a passage, an electromagnetic generator of this aspect preferably has higher connectivity with other devices in order to prevent leakage of liquid.

In a preferred embodiment of the seventh aspect of the present invention, the passage and the first electrode (2*a*) are the inner surface and the outer surface of one cylindrical body.

Alternatively, in a preferred embodiment of the seventh aspect of the present invention, an electromagnetic field generator further comprises a cylindrical inner casing (32) arranged on the inner peripheral surface side of the casing (1). In this case, the passage and inner casing (32) are the inner surface and the outer surface of one cylindrical body.

Effect of the Invention

According to the present invention, a small ion pump system can be provided.

According to the present invention, an ion pump system having a high air-exhausting capacity and vacuum-maintaining capacity can be provided.

According to the present invention, an ion pump system capable of adjusting drive modes suitable for the uses thereof can be provided.

According to the present invention, an ion pump system having high connectivity with other devices can be provided.

According to the present invention, an ion pump system capable of making room internally insusceptible to electromagnetic fields at low cost can be provided. Furthermore, according to the present invention, an electromagnetic field generator wherein space insusceptible to electromagnetic fields is a fluid passage can be provided.

DESCRIPTION OF THE NUMERALS

Figure 1:
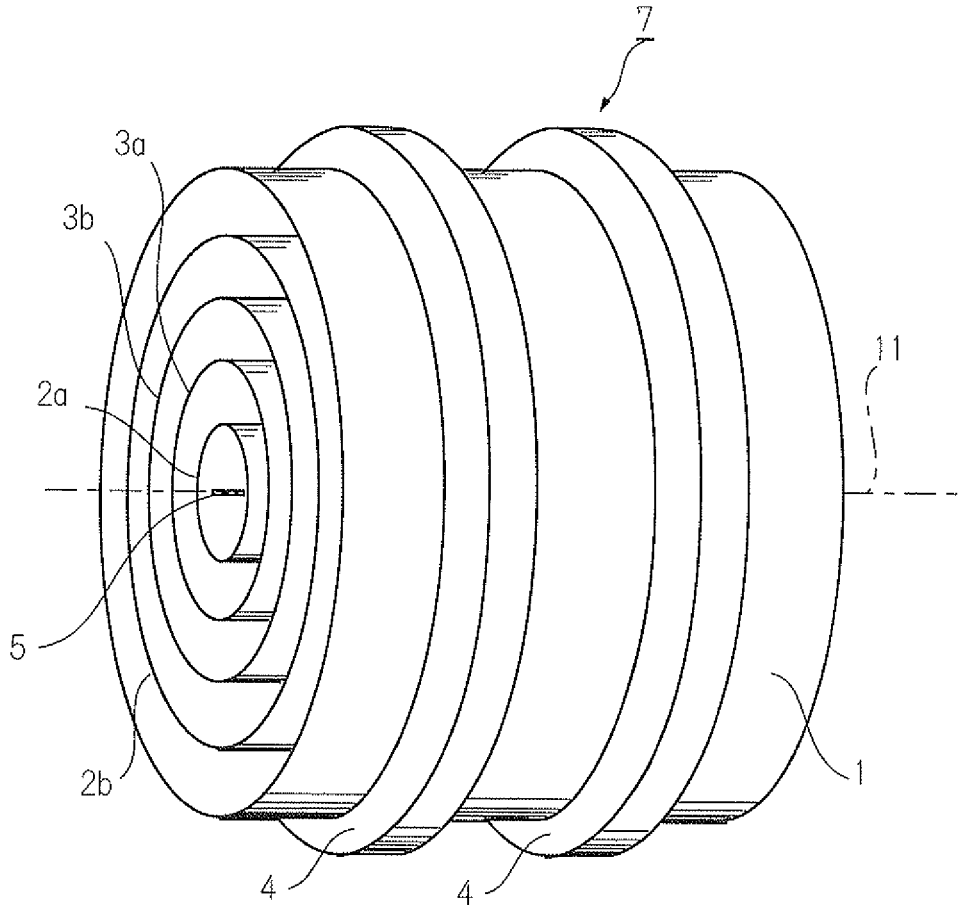
FIG. 1 is a conceptual diagram for explaining an ion pump system of the present invention.

1 Casing
2, 2*a*, 2*b*, 2*c*, 2*d* First electrode
3, 3*a*, 3*b*, 3*c*, 3*d* Second electrode Outer magnets
4*a* Outer magnets before movement
4*b* Outer magnets after movement
5 Inner magnets
6 Connecting part
7 Ion pump system
11 Central axis
12 First drive means
13 Second drive means
14 Movement mechanism
15 Third drive means
16 Fourth drive means
21 Magnetic field
22 Magnetic field concentration site
24 Magnetic material
30 Hollow space
32 Inner casing
34 Fixed member
36 Inner flange
38 Outer flange

MORE FOR CARRYING OUT THE INVENTION

Figure 2:
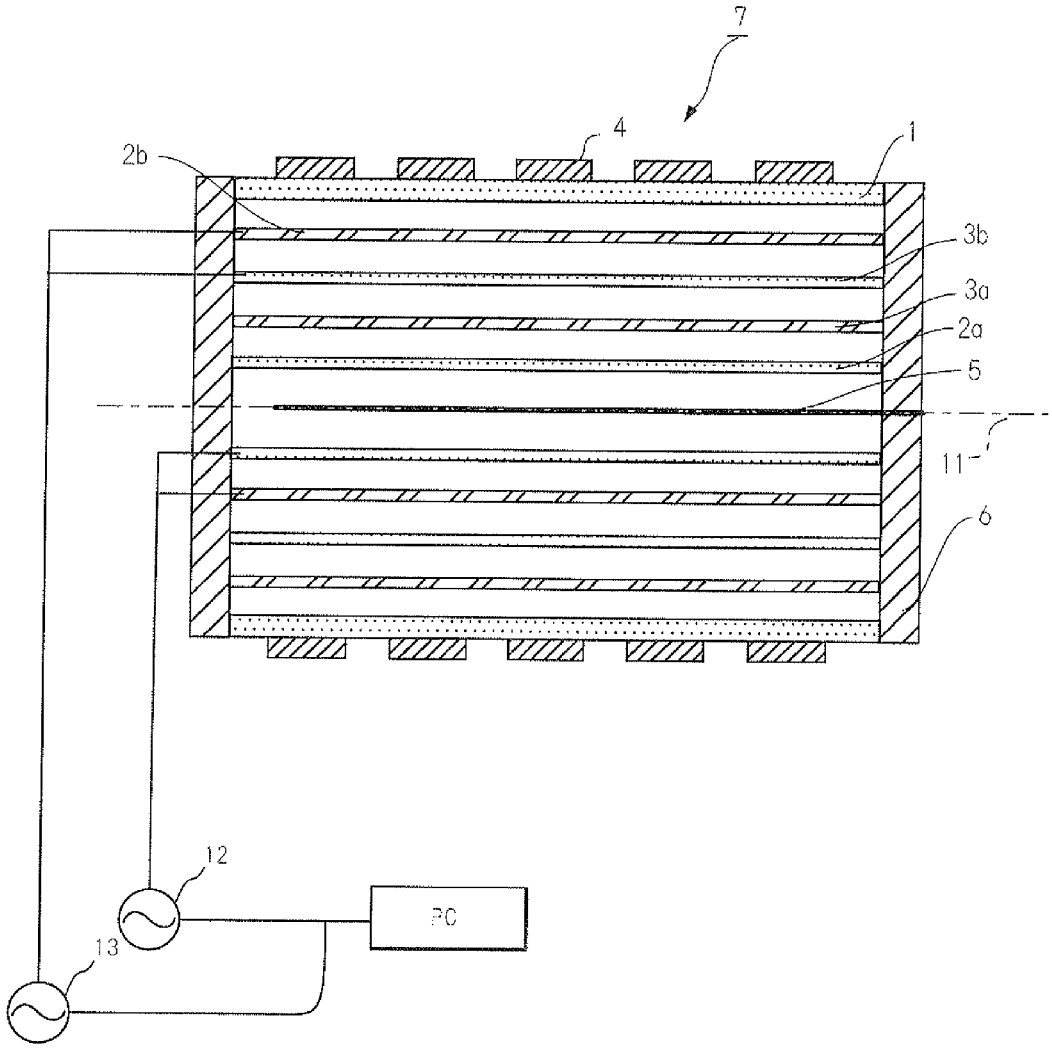
FIG. 2 is a conceptual diagram showing a cross-section view of an ion pump system.

Hereinafter, embodiments for carrying out the present invention will be described with reference to the accompanying figures. FIG. 1 is a conceptual diagram for explaining an ion pump system of the present invention. Also, FIG. 2 is a conceptual diagram showing a cross-section view of an ion pump system. FIG. 1 shows an ion pump system cut in the middle in order to show well electrodes. The first aspect of the present invention relates to an ion pump system having two pump parts. As shown in FIGS. 1 and 2, an ion pump system (7) according to the first aspect of the present invention comprises a casing (1), a first electrode group (2*a*, 2*b*), a second electrode group (3*a*, 3*b*), outer magnets (4) and an inner magnet (5). A casing (1) comprises a connecting part (6).

In this way, an ion pump system (7) of the present invention has a plurality of electrodes inside a casing (1). This can increase the getter electrode area and plasma generation. As a result, an ion pump system (7) of the present invention can have a high air-exhausting capacity and vacuum-maintaining capacity. A common ion pump is not provided with a complex system inside a casing in light of vacuum efficiency. The present invention purposely arrange a plurality of electrodes inside a casing (1), making it possible to effectively create a vacuum state.

A first electrode group (2*a*, 2*b*) is provided inside a casing (1). Also, a second electrode group (3*a*, 3*b*) is provided inside a casing (1). The first electrode (2*a*, 2*b*) and the second electrode (3*a*, 3*b*) have different polarities. Namely, one is a positive electrode and the other is a negative electrode. Outer magnets (4) are magnets for applying magnetic fields within a casing (1). Outer magnets (4) may be provided either inside or outside the casing (1) as far as they can apply a magnetic field within the casing (1). An inner magnets (5) are magnets provided within a casing (1). A connecting part (6) is a part for connecting a casing (1) or an ion pump system (7) with other devices.

Casing (1)

A casing (1) is a frame body of an ion pump system (7). As shown in FIG. 1, an example of the shape of a casing (1) is cylindrical. Various electrodes may be formed inside the frame body. Also, a casing is preferably provided with wiring for driving electrodes through which drive signals from a drive signal source can be delivered to inner electrodes. Magnets are usually provided inside a casing (1). However, as shown in FIG. 1, magnets may be provided outside a casing (1). The material of a casing includes a well-known material such as aluminum, titanium or stainless. Aluminum with titanium evaporated on the surface is preferable among these as the inner wall itself of a casing can be used as electrodes constituting a second electrode group or a first electrode group. This can make an ion pump system more lightweight and also make it smaller with a simple structure. Alternatively, electrodes and a casing (1) may be provided concentrically, and a plurality of magnets may be provided in the gaps between them, and an electrode fixed part for connecting electrodes with a casing (1) may be provided between the plurality of magnets. This make is possible to effectively fix electrodes to a casing (1).

Figure 3:
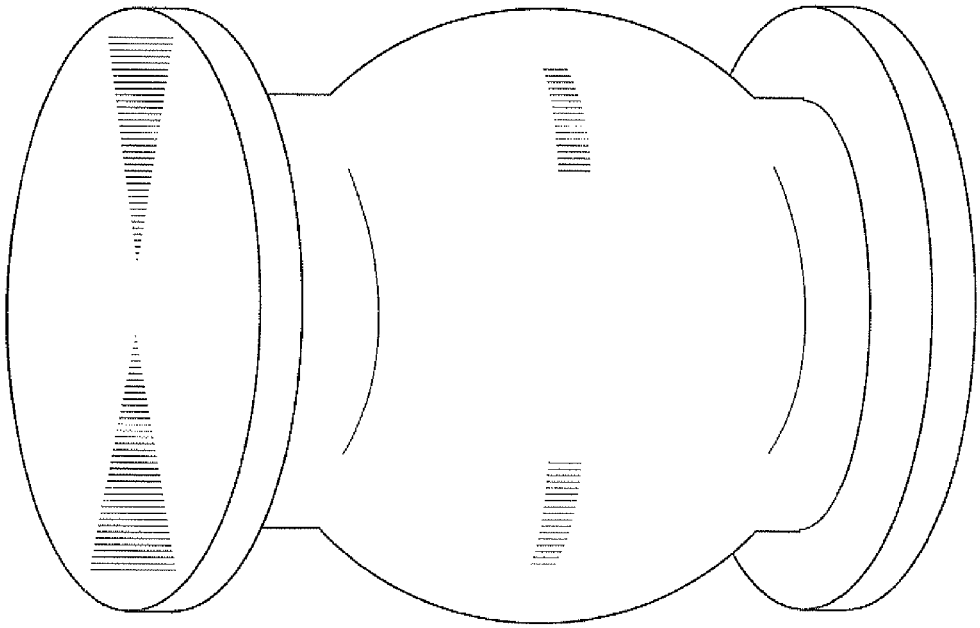
FIG. 3 is a conceptual diagram showing an example of a casing used in the present invention.

FIG. 3 is a conceptual diagram showing an example of a casing used in the present invention. Namely, as shown in FIG. 3, a casing (1) of the present invention may have an oval sphere shape of a chassis part or a spherical shape (contour) of a chassis part. The casing shown in FIG. 3 comprises cylindrical parts connected with connecting parts at each end and an oval sphere shape of a chassis part or a spherical shape of a chassis part, which is between two cylindrical parts. This use of a casing with an oval sphere shape of a chassis part or a spherical shape of a chassis part makes it possible to increase the getter electrode area and plasma generation, allowing effective ion adsorption. A larger greatest diameter of a chassis part of a casing is preferable as it can increase the getter electrode area. However, it may be in the way in case it is wider than a connecting part such as a flange. Thus, suppose the greatest diameter of a connecting part is D, the greatest diameter of a chassis part of a casing is preferably more than or equal to 0.95 D and less than or equal to D.

First electrode group (2*a*, 2*b*) and second electrode group (3*a*, 3*b*)

A first electrode group (2*a*, 2*b*) and a second electrode group (3*a*, 3*b*) have different polarities. Namely, one is an anode electrode and the rest is a cathode electrode. In the present invention, the polarities of cathode and anode may preferably be changed. This change in polarity can be attained by changing a drive voltage of a drive means as described later.

Figure 4:
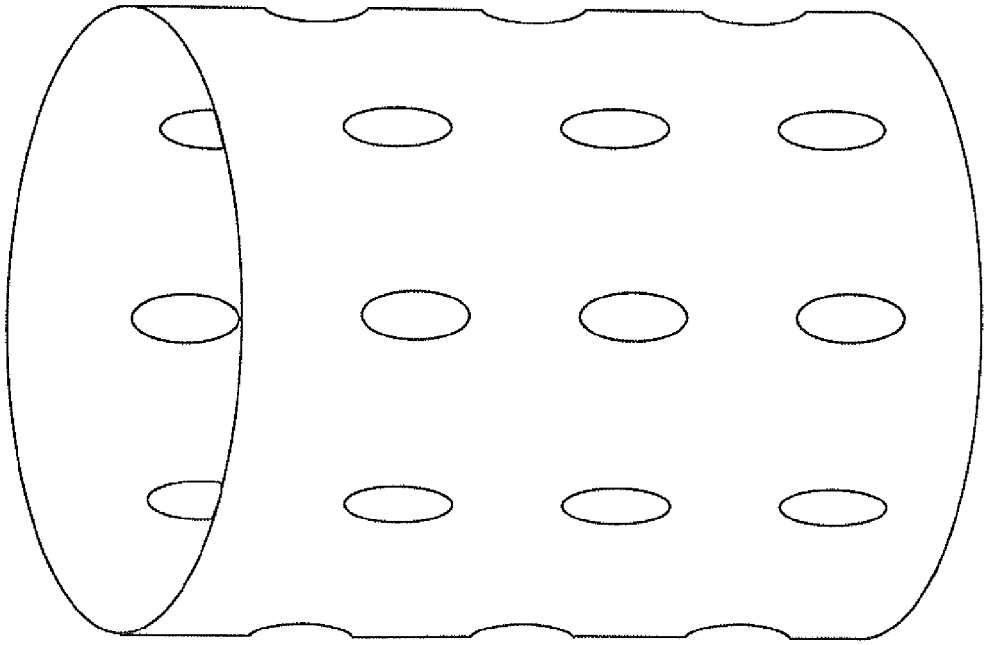
FIG. 4 is a diagram showing an example of an electrode provide inside a casing.

Well-known materials can appropriately be employed as a material used for electrodes constituting a first electrode group (2*a,* 2*b*) and a second electrode group (3*a*,3*b*). The plurality of electrodes constituting these electrode groups are preferably a rod-like electrodes (e.g. solid cylindrical electrode) provided on the central axis of a casing or hollow cylindrical electrodes located concentrically to a casing. FIG. 4 is a diagram showing an example of an electrode provide inside a casing (1). Namely, in the present invention, a plurality of layers are supposed to provided as an electrode layer, and thus an electrode with apertures as shown in FIG. 4 may appropriately be used. This use of an electrode with apertures makes it possible to move gas molecules inside a casing (1). Naturally, an electrode with a cylindrical shape without such apertures may be used. Preferably, a central magnet (inner magnet) may be provided on the central axis (11) of a casing (1). Furthermore, the central magnet preferably functions as one electrode constituting electrode groups.

A common ion pump uses ceramics in order to insulate a cathode and an anode. On the other hand, an ion pump system (7) of the above embodiment of the present invention fixes first electrodes or second electrodes to a casing or an electrode fixed part or a connecting part (6). This can effectively prevent the situation where first electrodes swing and contact second electrodes while an ion pump is in operation (during decompression of space between electrodes). This does not need insulators such as ceramics and can effectively increase vacuum. Namely, a preferred embodiment of the present invention is such that all of or at least more than one of electrode layers, which are within the cashing (1), are fixed to a casing (1) or an electrode fixed part such as a flange or a connecting part (6). In order to fix electrode layers, voids for placing electrodes may be provided in a metal constituting a casing (1), for example, into which each electrode may be placed for fixation. Furthermore, in order to maintain the shapes of each electrode layer, a spacer for connecting neighboring electrodes may be provided. A spacer fixes electrodes more strongly, which can effectively prevent the situation where electrodes swing and opposed electrodes contact each other while an ion pump system (7) is in operation. A spacer may correspond to the entire electrode fixed part as described above or may be a part thereof Magnets (4)

A known magnet used in an ion pump can appropriately be used as a type of magnet. More specifically, a magnet coil or a permanent magnet may be used. Magnets (4) of a preferred embodiment of the first aspect of the present invention are a plurality of cylindrical permanent magnets arranged at intervals in the direction parallel to the central axis—longitudinal direction of the central axis (11)—of a casing (1). Namely, as shown in FIG. 1, outer magnets (4) of this embodiment are a plurality of arranged ring-like permanent magnets. An ion pump system (7) of this mode, instead of using one cylindrical magnet, uses a plurality of cylindrical magnets and arranges them at a predetermined space. This can make an ion pump more lightweight and make it possible to generate a magnetic field effectively. Furthermore, this configuration optimizes a magnetic field arrangement structure caused by the interference effect of magnet groups of an inner pump part and magnets groups of an outer ion pump part and can realize more effective exhaust.

Connecting part (6)

A connecting part (6) is a part for connecting a casing (1) or an ion pump system (7) of the present invention with other device. "Other device" includes a vacuum chamber, a sample room, or the like for making vacuum state. A specific connecting part (6) is a flange. A connecting part (6) may be a part of the electrode fixed part. Alternatively, the electrode fixed part may double as the function of a connecting part (6).

Ion pump system (7)

An ion pump system (7) of the present invention comprises a plurality of pump parts inside one chamber (within the casing (1)). The operating principle of an ion pump is known. Hereinafter, the operating principle of an ion pump is briefly explained. When a voltage of about several kilovolts is applied to between a cathode and an anode of an ion pump, primary electrons are emitted from a cathode. As primary electrons emitted from a cathode are drawn to an anode and are susceptible to magnetic fields from permanent magnets, they circle following a long spiral path to reach an anode. On the way, primary electrons cause bump into neutral gas molecules and generate many positive ions and secondary electrons. The generated secondary electrons further follow a spiral path, bump into other gas molecules and generate positive ions and electrons. Then, respective ions etc. are adsorbed to electrodes.

An ion pump system (7) of the present invention can appropriately use a known configuration used in an ion pump in addition to the above configuration. For example, a heater, a cooler, or the like may appropriately be attached. Cooling with a cooler can improve the repairing efficiency of gasses. Meanwhile, heating with a heater can maintain a vacuum state to emit the gasses trapped by electrodes.

In the first aspect of the present invention, a casing (1), a first electrode group (2*a,* 2*b*), a second electrode group (3*a,* 3*b*) and inner magnets (5) are provided outwardly from the center of the casing in the following order, namely, as shown in FIGS. 1 and 2:

inner magnets (5) provided along a central axis (11) of a casing (1) or axisymmetrically with respect to the central axis (11);

a first electrode (2*a*) of a first electrode group provided at the innermost of the first electrode group;

a first electrode (3*a*) of a second electrode group provided at the innermost of the second electrode group;

a second electrode (3*b*) of a second electrode group provided in the second position from the inside among the second electrode group;

a second electrode (2*b*) of a first electrode group provided in the second position from the inside among the first electrode group; and outer magnets (4).

In this way, an ion pump system of the present invention has a plurality of electrodes therein, thereby increasing ion trap fields and as a result improving the efficiency of an ion pump system. Furthermore, as described later, an ion pump system of the present invention can drive an ion pump effectively depending on targets by driving the ion pump divided into a plurality of pump parts. In pump parts, space between a pair of electrodes is decompressed. Though FIG. 2 shows an example of an AC power supply for sake of simplicity, a DC power supply may be used as a drive power supply. Particularly, as a voltage applied to opposed electrodes in an ion pump is typically a DC power supply, a DC power supply may be used as a power supply.

A preferred embodiment of the first aspect of the present invention comprises a first drive means (12) and a second drive means (13). The first drive means (12) drives a first electrode (2*a*) of a first electrode group and a first electrode (3*a*) of a second electrode group. The second drive means (13) drives a second electrode (3*b*) of a second electrode group and a second electrode (2*b*) of a first electrode group.

The first drive means (12) drives a first pump part comprising an inner magnet (5), a first electrode (2*a*) of a first electrode group and a first electrode (3*a*) of a second electrode group. Similarly, the second drive means (13) drives a second pump part comprising a second electrode (3*b*) of a second electrode group, a second electrode (2*b*) of a first electrode group, and outer magnets (4).

The ion pump system (7) of this embodiment can drive a first pump part and a second pump part independently by driving a first drive means (12) and a second drive means (13) independently. The second pump, which is set outside of the first pump part, has large output amount and it requires a lot of electric power. Contrary, the first pump part has little output and it requires small electric power. The system can drive both of the pump parts such that the system can attain suitable performance and electric efficiency based on work load. The preferred embodiment of the present invention drives pluralities of pump parts independently. When the system decides to drive only one or some of the ion pump parts, the system can drive the ion pump parts. The system can drive suitable pumps based on the required level of vacuum. Namely, the present invention can modify mode of driving ion pumps and can control power consumption based on the required work loads.

A preferred embodiment of the first aspect of the present invention relates to an ion pump system as described in any of the above, wherein a first electrode (3*a*) of a second electrode group and a second electrode (3*b*) of a second electrode group are an inner surface and an outer surface of one cylindrical electrode. This use of one cylindrical electrode with respect to electrodes having the same polarity makes it possible to downsize an ion pump system (7).

A preferred embodiment of the first aspect of the present invention relates to an ion pump system as described in any of the above, wherein outer magnets (4) comprise a plurality of cylindrical permanent magnets arranged at intervals in the longitudinal direction of a casing (1).

This use of cylindrical permanent magnets makes it possible to effectively generate a magnetic field inside a casing (1).

A preferred embodiment of the first aspect of the present invention relates an ion pump system as described in any of the above, wherein the ion pump system further comprises a movement mechanism (14) for moving a plurality of cylindrical permanent magnets toward the longitudinal direction of a casing (1). This movement mechanism (14) that can change the magnetic field concentration field makes it possible to prevent degradation of an ion pump system as well as improve the efficiency of an ion pump system.

Figure 5:
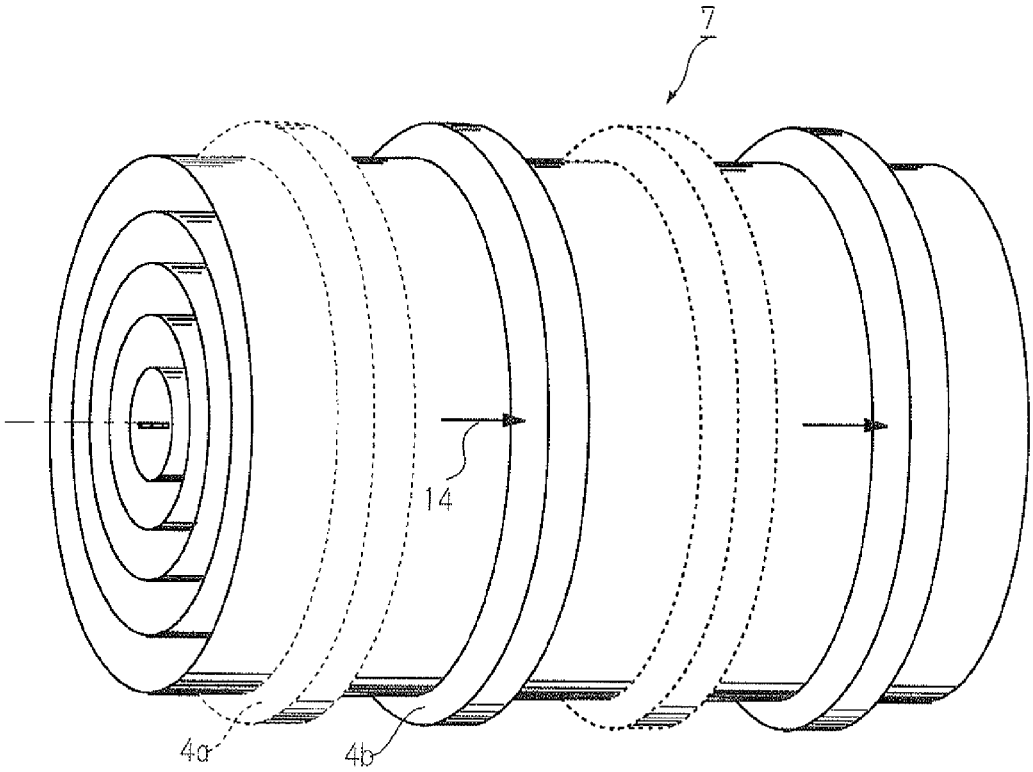
FIG. 5 is a conceptual diagram of an ion pump system having a movement mechanism.

FIG. 5 is a conceptual diagram of an ion pump system having a movement mechanism. That is, an ion pump system (7) of this mode has a movement mechanism for moving magnets from the position where a magnetic field is strong to the position where a magnetic field is weak. This can move magnets from a pre-movement state (4*a*) to a post-movement state (4*b*). In the same way, a movement mechanism for moving an inner magnet (5) may be provided in an ion pump system (7).

Figure 6:
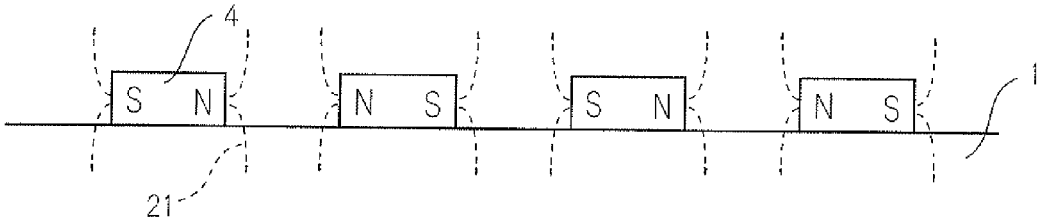
FIG. 6 is a conceptual diagram showing magnetic fields by outer magnets in an ion pump system having fixed outer magnets.

FIG. 6 is a conceptual diagram showing magnetic fields by outer magnets in an ion pump system having fixed outer magnets. In the figure, magnetic fields are denoted by numeral 21. As shown in the FIG. 6, when outer magnets are fixed, magnetic fields begin to leak not only to the inside of a casing but also to the outside of a casing.

Figure 7:
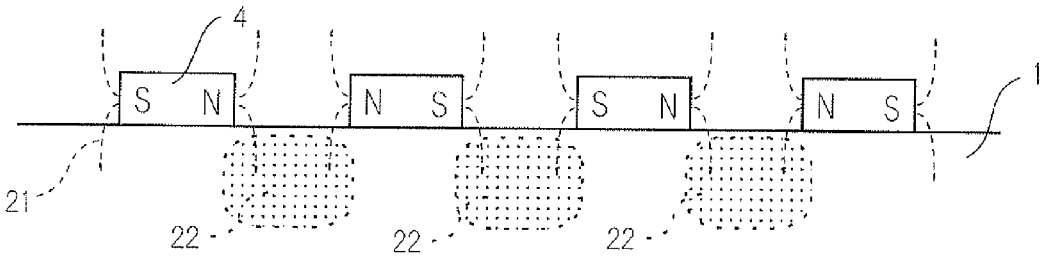
FIG. 7 is a conceptual diagram showing sites for concentration of magnetic fields by outer magnets in an ion pump system having fixed outer magnets.

FIG. 7 is a conceptual diagram showing sites for concentration of magnetic fields by outer magnets in an ion pump system having fixed outer magnets. As shown in FIG. 7, in an ion pump having fixed outer magnets, magnetic fields concentrate on the sites denoted by numeral 22. That is, in an ion pump having fixed outer magnets, getter surfaces are concentrated and thus vacuum efficiency decreases earlier. Furthermore, as getter surfaces are concentrated, this ion pump may degrade earlier.

Figure 8:
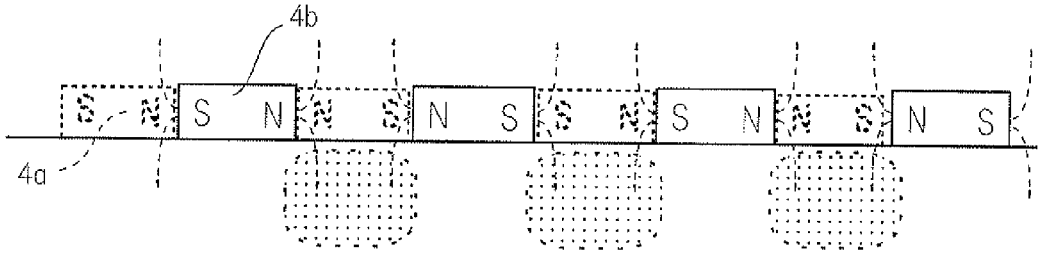
FIG. 8 is a conceptual diagram showing magnetic fields by outer magnets after having moved magnets using a movement mechanism.

FIG. 8 is a conceptual diagram showing magnetic fields by outer magnets after having moved magnets using a movement mechanism. As shown in FIG. 8, use of a movement mechanism (14) can displace the sites where magnetic fields are concentrated. This enables gas molecules to be induced and adsorbed to the non-degraded adsorption surface, thereby improving adsorption efficiency. An example of a movement mechanism (14) is such that it provides connection between pluralities of cylindrical permanent magnets and loads them on a rail. And a movement mechanism applies force to permanent magnets using an actuator and changes the positions of the plurality of cylindrical permanent magnets. A movement mechanism (14) may be such that it allows manual movement of magnets. A preferred embodiment of the first aspect of the present invention relates to an ion pump system, wherein cylindrical permanent magnets are removable from a casing (1). This ability to remove cylindrical permanent magnets makes it possible to improve productivity of an ion pump system (7) and makes maintenance easier.

In a preferred embodiment of the first aspect of the present invention, pluralities of cylindrical permanent magnets are configured so that the surface of neighboring cylindrical permanent magnets may have the same polarity. And an ion pump system of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified. In this way, as magnetic materials (24) are arranged between neighboring magnets, spatial distribution of magnetic flux can be adjusted and magnetic flux penetration into the electromagnetic direction can be promoted. These magnetic materials (24) include a permanent magnet, an electromagnet, soft iron, iron, a ferrite, or the like, having magnetic flux rectification effects.

Figure 9:
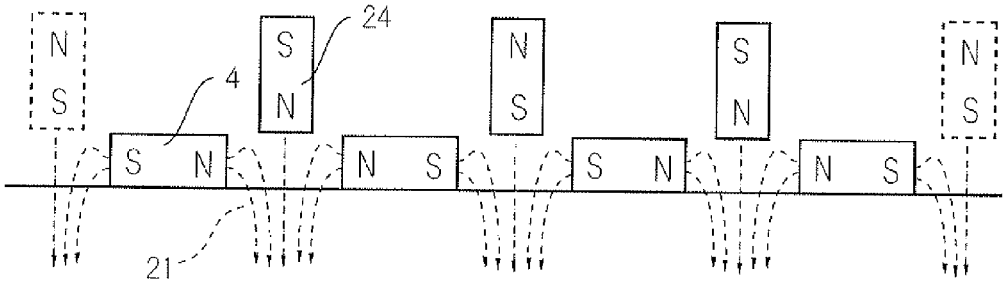
FIG. 9 is a conceptual diagram showing magnetic fields by outer magnets in an ion pump system comprising magnetic materials.

FIG. 9 is a conceptual diagram showing magnetic fields by outer magnets in an ion pump system comprising magnetic materials. Namely, in FIG. 9, magnets are used as magnetic materials. As shown in FIG. 9, this ion pump system can strengthen magnetic fields formed inside a casing by further arranging magnets between outer magnets (4). This can improve the efficiency of an ion pump system. Such magnetic materials (24) may be cylindrical magnets.

Figure 10:
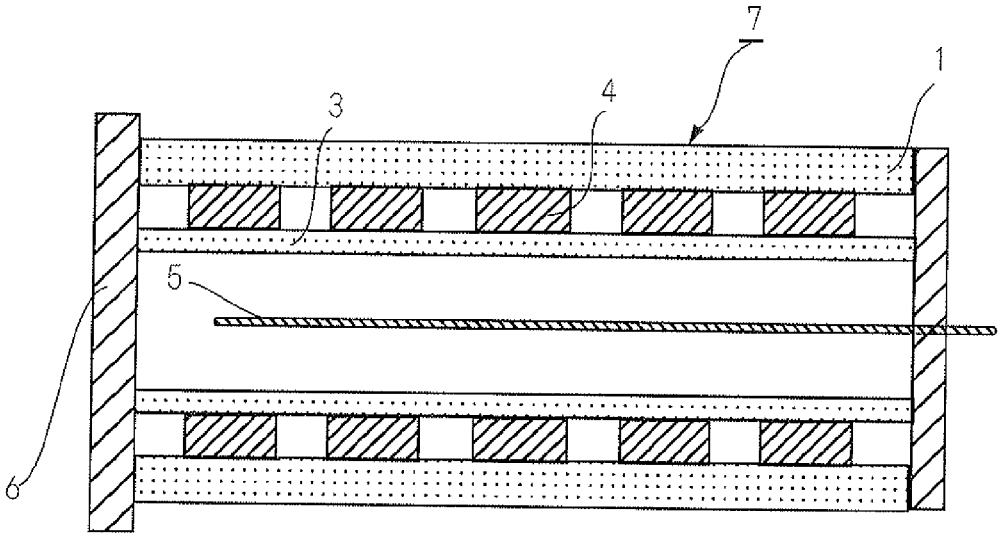
FIG. 10 is a conceptual diagram of an ion pump system provided with outer magnets between the inner surface of a casing and electrodes constituting the outermost layer wherein the casing does not particularly function as an electrode.
Figure 11:
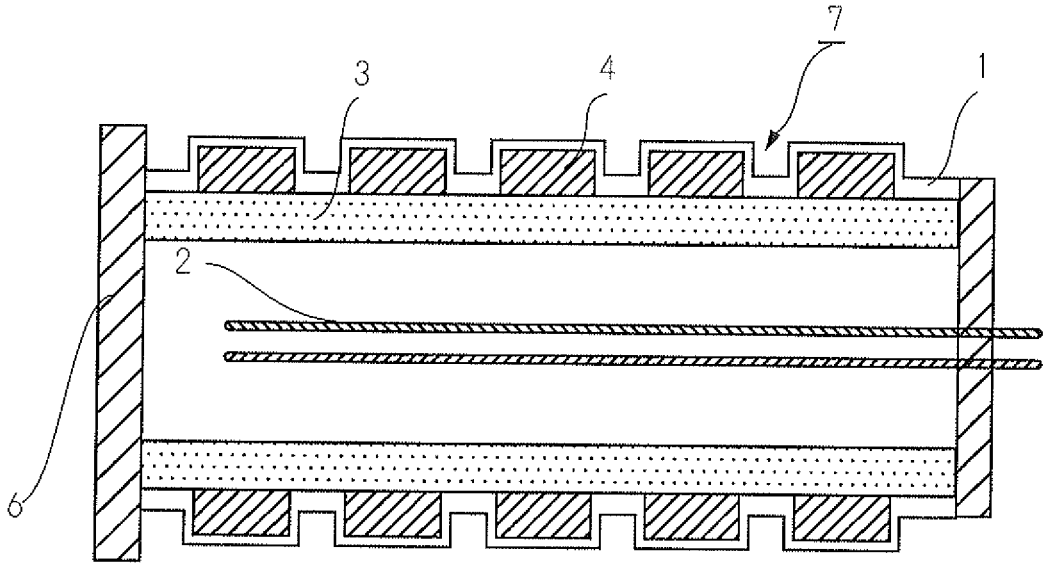
FIG. 11 is a conceptual diagram of an ion pump system wherein a casing has convex-concave portions in shape for storing magnets where magnets are arranged.

As shown in FIG. 10, an ion pump system of the present invention may be such that a casing does not particularly function as an electrode and magnets may be provided between the inner surface of a casing (1) and electrodes constituting the outermost layer (e.g. electrode (3)). Namely, in this case, magnets may not be provided on the outer surface of a casing (1). Note that electrodes are not drawn in FIG. 10 for sake of simplicity. Furthermore, as shown in FIG. 11, an ion pump system of the present invention may be one wherein a casing (1) has convex-concave portions in shape where magnets are arranged.

Figure 12:
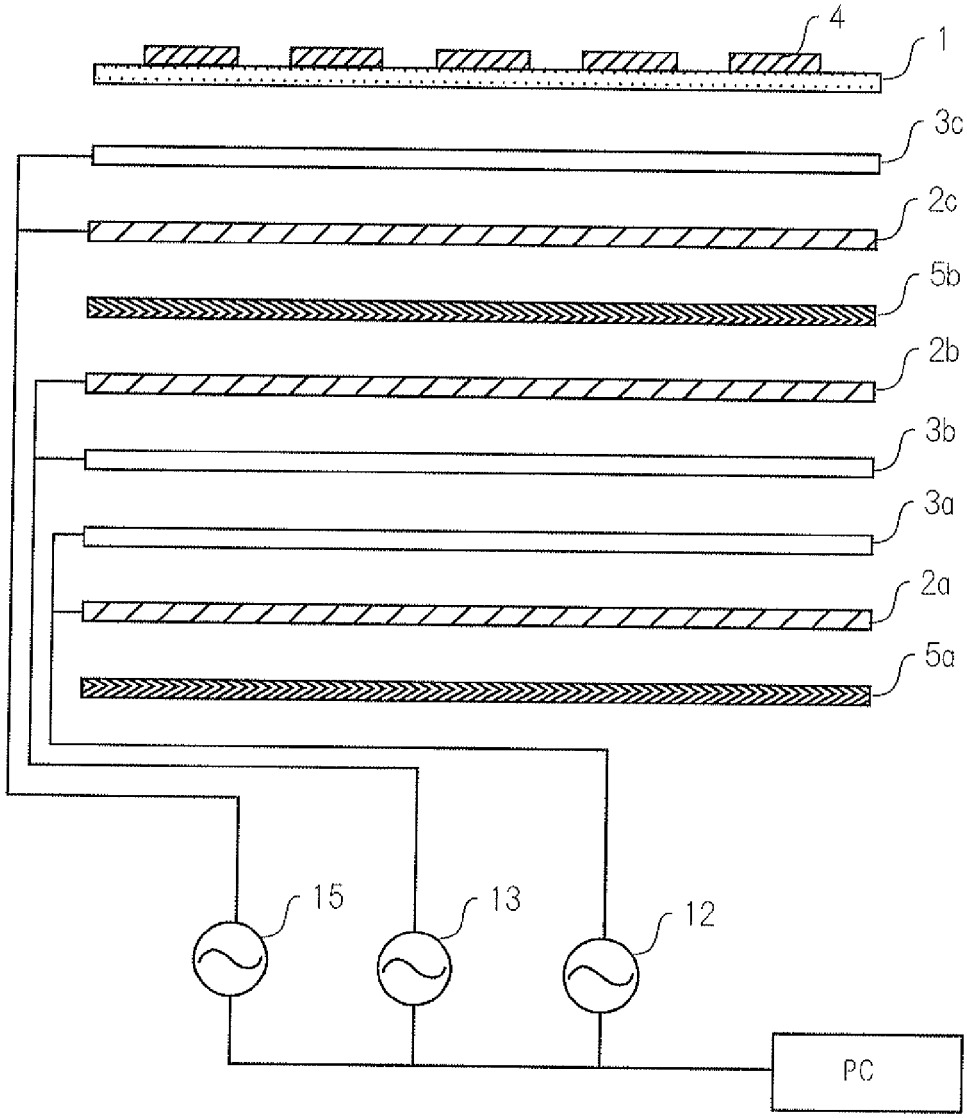
FIG. 12 is a diagram for explaining an ion pump system according to the second aspect of the present invention.

FIG. 12 is a diagram for explaining an ion pump system according to the second aspect of the present invention. As shown in FIG. 12, the second aspect of the present invention relates to an ion pump system having three pump parts. The ion pump system basically employs the same configuration as the first aspect of the present invention. Thus, explanation of each component and movement explanation of each component as explained in the first aspect of the present invention are quoted. The ion pump system comprises a casing (1), a first electrode group (2*a*, 2*b*, 2*c*), a second electrode group (3*a*, 3*b*, 3*c*), outer magnets (4), inner magnets (5*a*, 5*b*) and a connecting part (6).

A casing (1), a first electrode group (2*a*, 2*b*, 2*c*), a second electrode group (3*a*, 3*b*, 3*c*) and inner magnets (5*a*, 5*b*) are provided outwardly from the center of the casing in the following order, namely:

an inner magnet (5*a*) provided along a central axis (11) of a casing (1) or axisymmetrically with respect to the central axis (11);

a first electrode (2*a*) of a first electrode group provided at the innermost of the first electrode group;

a first electrode (3*a*) of a second electrode group provided at the innermost of the second electrode group;

a second electrode (3*b*) of a second electrode group provided in the second position from the inside among the second electrode group;

a second electrode (2*b*) of a first electrode group provided in the second position from the inside among the first electrode group;

a cylindrical inner magnet (5*b*)

a third electrode (2*c*) of a first electrode group provided in the third position from the inside among the first electrode group;

a third electrode (3*c*) of a second electrode group provided in the third position from the inside among the second electrode group; and outer magnets (4).

A preferred embodiment of the second aspect of the present invention comprises first through third drive means (12, 13, 15). The first drive means (12) drives a first electrode (2*a*) of a first electrode group and a first electrode (3*a*) of a second electrode group. The second drive means (13) drives a second electrode (3*b*) of a second electrode group and a second electrode (2*b*) of a first electrode group. The third drive means (15) drives a third electrode (2*c*) of a first electrode group and a third electrode (3*c*) of a second electrode group.

The first drive means (12) drives a first pump part comprising an inner magnet (5*a*), a first electrode (2*a*) of a first electrode group and a first electrode (3*a*) of a second electrode group. The second drive means (13) drives a second pump part comprising a second electrode (3*b*) of a second electrode group, a second electrode (2*b*) of a first electrode group, and a cylindrical inner magnet (5*b*). Similarly, the third drive means (15) drives a third pump part comprising a third electrode (2*c*) of a first electrode group, a third electrode (3*c*) of a second electrode group and outer magnets (4).

Therefore, the ion pump system (7) of this mode can drive a first pump part, a second pump part and a third pump part independently by driving a first drive means (12), a second drive means (13) and a third drive means (15) independently.

A preferred embodiment of the second aspect of the present invention relates to an ion pump system as described in any of the above, wherein a first electrode (3*a*) of a second electrode group and a second electrode (3*b*) of a second electrode group are an inner surface and an outer surface of one cylindrical electrode.

A preferred embodiment of the second aspect of the present invention relates to an ion pump system as described in any of the above, wherein outer magnets (4) comprise a plurality of cylindrical permanent magnets arranged at intervals in the longitudinal direction of a casing (1).

A preferred embodiment of the second aspect of the present invention relates an ion pump system as described in any of the above, wherein the ion pump system further comprises a movement mechanism (14) for moving a plurality of cylindrical permanent magnets toward the longitudinal direction of a casing (1).

In a preferred embodiment of the second aspect of the present invention, pluralities of cylindrical permanent magnets are configured so that the surface of neighboring cylindrical permanent magnets may have the same polarity. And an ion pump system (7) of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified. In this way, as magnetic materials (24) are arranged between neighboring magnets, spatial distribution of magnetic flux can be adjusted and magnetic flux penetration into the electromagnetic direction can be promoted. These magnetic materials (24) include a permanent magnet, an electromagnet, soft iron, iron, a ferrite, or the like, having magnetic flux rectification effects.

Figure 13:
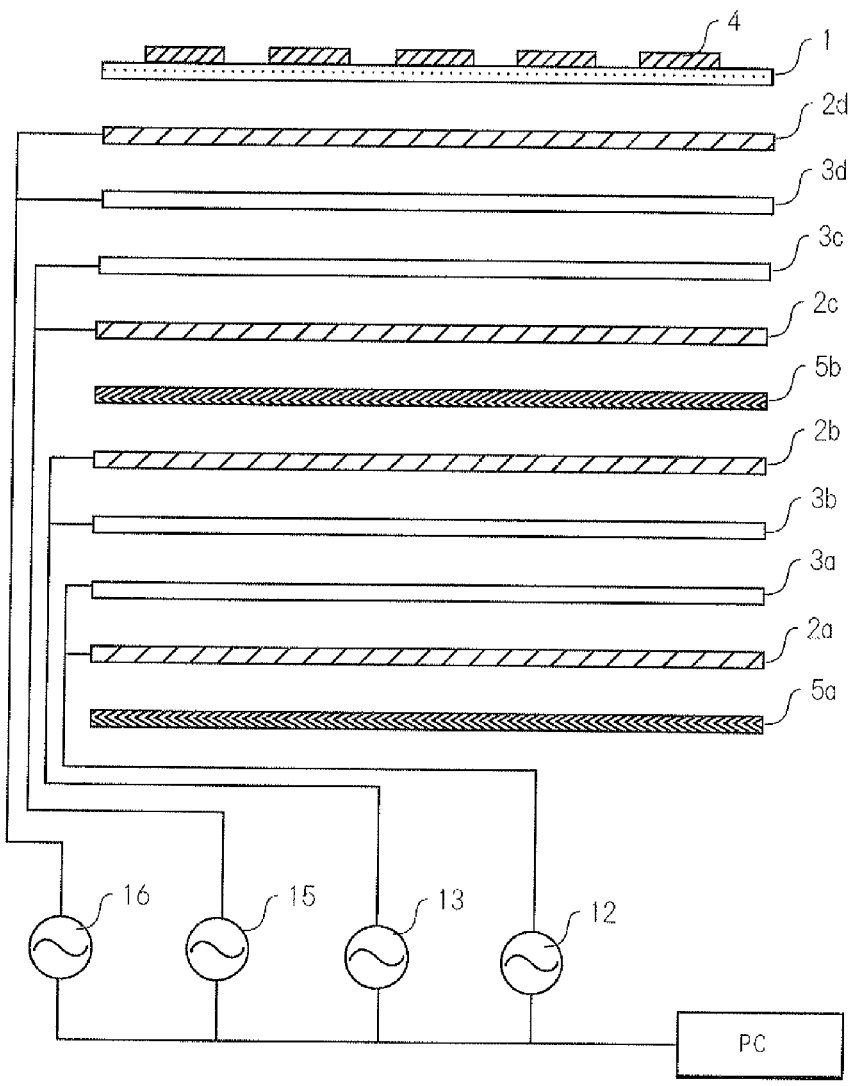
FIG. 13 is a diagram for explaining an ion pump system according to the third aspect of the present invention.

FIG. 13 is a diagram for explaining an ion pump system according to the third aspect of the present invention. As is shown in FIG. 13, the third aspect of the present invention relates to an ion pump system having four pump parts. The ion pump system basically employs the same configuration as the first aspect of the present invention. Thus, explanation of each component and movement explanation of each component as explained in the first aspect of the present invention are quoted. The ion pump system comprises a casing (1), a first electrode group (2*a*, 2*b*, 2*c*, 2*d*), a second electrode group (3*a*, 3*b*, 3*c*, 3*d*), outer magnets (4), inner magnets (5*a*, 5*b*) and a connecting part (6).

A casing (1), a first electrode group (2*a*, 2*b*, 2*c*, 2*d*), a second electrode group (3*a*, 3*b*, 3*c*, 3*d*) and inner magnets (5*a*, 5*b*) are provided outwardly from the center of the casing in the following order, namely:

an inner magnet (5*a*) provided along a central axis (11) of a casing (1) or axisymmetrically with respect to the central axis (11);

a first electrode (2*a*) of a first electrode group provided at the innermost of the first electrode group;

a first electrode (3*a*) of a second electrode group provided at the innermost of the second electrode group;

a second electrode (3*b*) of a second electrode group provided in the second position from the inside among the second electrode group;

a second electrode (2*b*) of a first electrode group provided in the second position from the inside among the first electrode group;

a cylindrical inner magnet (5*b*)

a third electrode (2*c*) of a first electrode group provided in the third position from the inside among the first electrode group;

a third electrode (3*c*) of a second electrode group provided in the third position from the inside among the second electrode group;

a fourth electrode (3*d*) of a second electrode group provided in the fourth position from the inside among the second electrode group;

a fourth electrode (2*d*) of a first electrode group provided in the fourth position from the inside among the first electrode group; and outer magnets (4).

A preferred embodiment of the third aspect of the present invention comprises first through fourth drive means (12, 13, 15, 16). The first drive means (12) drives a first electrode (2*a*) of a first electrode group and a first electrode (3*a*) of a second electrode group. The second drive means (13) drives a second electrode (3*b*) of a second electrode group and a second electrode (2*b*) of a first electrode group. The third drive means (15) drives a third electrode (2*c*) of a first electrode group and a third electrode (3*c*) of a second electrode group. The fourth drive means (16) drives a fourth electrode (3*d*) of a second electrode group and a fourth electrode (2*d*) of a first electrode group.

The first drive means (12) drives a first pump part comprising an inner magnet (5*a*), a first electrode (2*a*) of a first electrode group and a first electrode (3*a*) of a second electrode group. The second drive means (13) drives a second pump part comprising a second electrode (3*b*) of a second electrode group, a second electrode (2*b*) of a first electrode group, and a cylindrical inner magnet (5*b*). The third drive means (15) drives a third pump part comprising a third electrode (2*e*) of a first electrode group and a third electrode (3*c*) of a second electrode group. The third drive means (16) drives a fourth pump part comprising a fourth electrode (3*d*) of a second electrode group, a fourth electrode (2*d*) of a first electrode group and outer magnets (4).

Therefore, the ion pump system of this embodiment can drive a first pump part, a second pump part, a third pump part and a fourth pump part independently by driving a first drive means (12), a second drive means (13), a third drive means (15) and a fourth drive means (16) independently.

A preferred embodiment of the third aspect of the present invention relates to an ion pump system as described in any of the above, wherein outer magnets (4) comprise a plurality of cylindrical permanent magnets arranged at intervals in the longitudinal direction of a easing (1).

A preferred embodiment of the third aspect of the present invention relates an ion pump system as described in any of the above, wherein the ion pump system further comprises a movement mechanism (14) for moving a plurality of cylindrical permanent magnets toward the longitudinal direction of a casing (1).

In a preferred embodiment of the third aspect of the present invention, pluralities of cylindrical permanent magnets are configured so that the surface of neighboring cylindrical permanent magnets may have the same polarity. And an ion pump system (7) of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified. In this way, as magnetic materials (24) are arranged between neighboring magnets, spatial distribution of magnetic flux can be adjusted and magnetic flux penetration into the electromagnetic direction can be promoted. These magnetic materials (24) include a permanent magnet, an electromagnet, soft iron, iron, a ferrite, or the like, having magnetic flux rectification effects.

The fourth aspect of the present invention relates to an ion pump system having a plurality of pump parts. The ion pump system basically can employ the same configuration as the first aspect of the present invention. Thus, explanation of each component and movement explanation of each component as explained in the first aspect of the present invention are quoted. The ion pump system comprises a casing, a first electrode group, a second electrode group, outer magnets and inner magnets. The casing comprises a connecting part for connecting an ion pump system with other devices.

A casing, a first electrode group, a second electrode group and inner magnets are provided outwardly from the center of the casing in the following order, namely:

inner magnets provided along a central axis of a casing or axisymmetrically with respect to the central axis;

a first electrode aggregate part comprising electrodes included in a first electrode group and electrodes included in a second electrode group;

cylindrical inner magnets located at the innermost;

a nth electrode aggregate part comprising electrodes included in a first electrode group and electrodes included in a second electrode group for each integer from 2 to n where n is an integer 2;

cylindrical inner magnets provided in the nth position from the inside; and outer magnets (4).

The first electrode aggregate part is arranged in the following order, namely:

a first electrode of a first electrode group provided at the innermost of the first electrode group;

a first electrode of a second electrode group provided at the innermost of the second electrode group;

a second electrode of a second electrode group provided in the second position from the inside among the second electrode group; and a second electrode of a first electrode group provided in the second position from the inside among the first electrode group.

The nth through second electrode aggregate parts are arranged in the following order, namely:

a certain electrode of a first electrode group;

a certain electrode of a second electrode group;

another electrode of a second electrode group; and another electrode of a first electrode group.

The nth electrode aggregate part has the following two patterns of configuration. The first configuration pattern of the nth electrode aggregate part is the following order, namely:

a certain electrode of a first electrode group;

a certain electrode of a second electrode group;

a certain electrode of a second electrode group; and a certain electrode of a first electrode group.

The second configuration pattern of the nth electrode aggregate part is the following order, namely:

a certain electrode of a first electrode group; and a certain electrode of a second electrode group.

A preferred embodiment of the fourth aspect of the present invention relates to an ion pump system as described in any of the above, wherein outer magnets comprise a plurality of cylindrical permanent magnets arranged at intervals in the longitudinal direction of a casing.

A preferred embodiment of the fourth aspect of the present invention relates an ion pump system as described in any of the above, wherein the ion pump system further comprises a movement mechanism (14) for moving a plurality of cylindrical permanent magnets toward the longitudinal direction of a casing. The movement mechanism (14) may be such that it allows manual movement of magnets.

In a preferred embodiment of the fourth aspect of the present invention, pluralities of cylindrical permanent magnets are configured so that the surface of neighboring cylindrical permanent magnets may have the same polarity. And an ion pump system of this embodiment further comprises a magnetic material (24) between neighboring magnets of a plurality of cylindrical permanent magnets. The magnetic material (24) is arranged so that the flux going from the neighboring surface to the central axis (11) of the casing (1) may be rectified. In this way, as magnetic materials (24) are arranged between neighboring magnets, spatial distribution of magnetic flux can be adjusted and magnetic flux penetration into the electromagnetic direction can be promoted. These magnetic materials (24) include a permanent magnet, an electromagnet, soft iron, iron, a ferrite, or the like, having magnetic flux rectification effects.

The above-described modes of first through fourth aspects minimize the idle space of space inside a casing (1), thereby making the best use of space. Other aspects described later, instead of making the most of space, make space insusceptible to an electromagnetic field inside a casing (1).

Hereinafter, other aspects (fifth and sixth aspects) of the present invention will be described with reference to the accompanying figures.

Figure 14:
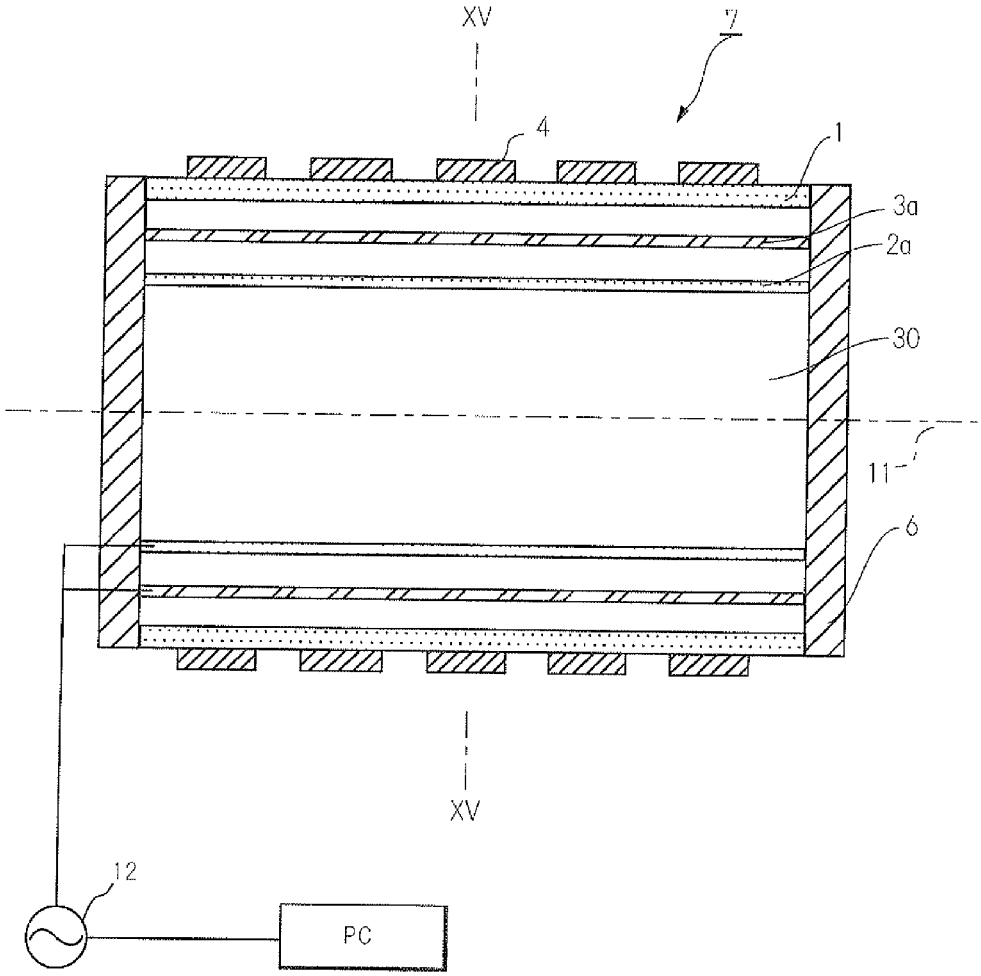
FIG. 14 is a diagram for explaining an ion pump system according to the fifth aspect of the present invention.
Figure 15:
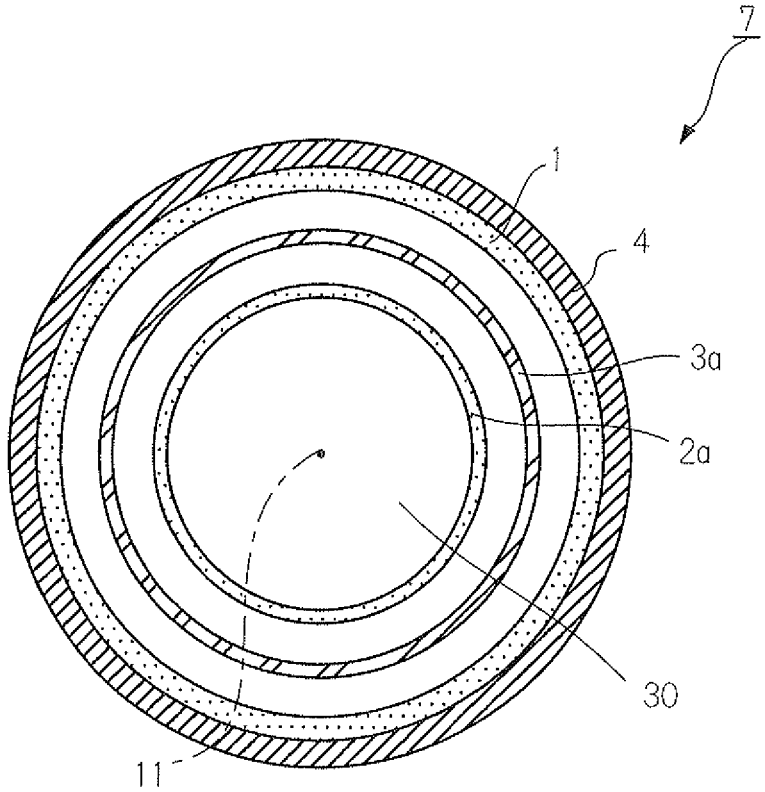
FIG. 15 is a cross-section view along line XV-XV of FIG. 14.

FIG. 14 is a diagram for explaining an ion pump system according to the fifth aspect of the present invention. And FIG. 15 is a conceptual diagram showing a cross-section perpendicular to the central axis of an ion pump system shown in FIG. 14. The fifth aspect of the present invention relates to an ion pump system having one pump part. As shown in FIGS. 14 and 15, an ion pump system according to the fifth aspect of the present invention comprises a casing (1), a first electrode (2*a*), a second electrode (3*a*) and outer magnets (4). A casing (1) comprises a connecting part (6). A casing (1), a first electrode (2*a*) and a second electrode (3*a*) are cylindrical in shape.

In this way, an ion pump system of the present invention has a pair of electrodes (2*a*, 3*a*) inside a casing (1) and is provided with a hollow space (30) along the central axis of a casing (1) on the inner peripheral surface side of a first electrode (2*a*). Particularly, in the fifth aspect, the inner peripheral surface of a first electrode (2*a*) forms a part of the outer peripheral surface of a hollow space (30). The hollow space (30) is used as a passage of beams or particle beams emitted from an electron microscope, an electron beam exposure device or the like. Beams or particle beams are formed of electrons, protons or charged particles. A common ion pump, as it is susceptible to an electromagnetic field, is not provided with a hollow space (30) inside a casing. The present invention purposely provides a hollow space (30) inside a casing (1), making it possible to introduce various materials (fluid or electrons) or a part of other device into the hollow space (30). As described later, a hollow space (30) is arranged at the site insusceptible to an electromagnetic field.

A first electrode (2*a*) is provided inside a casing (1). A second electrode (3*a*) is provided inside a casing (1). The first electrode (2*a*) and the second electrode (3*a*) have different polarities. Namely, one is an anode and the other is a cathode. Outer magnets (4) are magnets for applying magnetic fields within a casing (1). Outer magnets (1) may be provided either inside or outside the casing (1) as far as they can apply magnetic fields within the casing (1). A connecting part (6) is a part for connecting a casing (1) or an ion pump system (7) with other devices.

Casing (1)

A casing is a frame body of an ion pump system (7). an example of the shape of a casing (1) is tubular, such as cylindrical as shown in FIGS. 14 and 15. Various electrodes may be formed inside the frame body. Also, a casing is preferably provided with wiring for driving electrodes through which drive signals from a drive signal source can be delivered to inner electrodes. Magnets are usually provided inside a casing (1). However, as shown in FIGS. 14 and 15, magnets may be provided outside a casing (1). The material of a casing includes a known material such as aluminum, titanium or stainless. Aluminum with titanium evaporated on the surface is preferable among these as the inner wall itself of a casing (1) can be used as electrodes constituting a second electrode (3*a*) or a first electrode (2*a*). This can make an ion pump system more lightweight and also make it smaller with a simple structure. Alternatively, electrodes and a casing (1) may be provided concentrically, and a plurality of magnets may be provided in the gaps between them, and an electrode fixed part for connecting electrodes with a casing (1) may be provided between the plurality of magnets. This make is possible to effectively fix electrodes to a casing (1).

As shown in FIG. 3, a casing (1) of the present invention may have an oval sphere shape of a chassis part or a spherical shape (contour) of a chassis part. The casing shown in FIG. 3 comprises cylindrical parts connected with connecting parts at each end and an oval sphere shape of a chassis part or a spherical shape of a chassis part. This use of a casing with an oval sphere shape off chassis part or a spherical shape of a chassis part makes it possible to increase the getter electrode area and plasma generation, allowing effective ion adsorption. A larger greatest diameter of a chassis part of a casing is preferable as it can increase the getter electrode area. However, it may be in the way in case it is wider than a connecting part such as a flange. Thus, suppose the greatest diameter of a connecting part is D, the greatest diameter of a chassis part of a casing is preferably more than or equal to 0.95 D and less than or equal to D.

First Electrode (2*a*) and Second Electrode (3*a*)

A first electrode (2*a*) and a second electrode (3*a*) are a pair of electrodes having different polarities. Namely, one is an anode and the rest is a cathode. In the present invention, the polarities of cathode and anode may preferably be changed. This change in polarity can be attained by changing a drive voltage of a drive means as described later.

Known materials can appropriately be employed as a material used for electrodes constituting a first electrode (2*a*) and a second electrode (3*a*). Each of these electrodes is preferably a cylindrical electrode located concentrically to a casing (1). As shown in FIG. 4, an electrode with apertures may appropriately be used as each electrode. This use of an electrode with apertures makes it possible to move gas molecules inside a casing (1). Naturally, an electrode with a cylindrical shape without such apertures may be used.

A common ion pump uses ceramics etc. in order to insulate a cathode and an anode. On the other hand, an ion pump system of the above mode of the present invention fixes first electrodes or second electrodes to a casing or the electrode fixed part or the connecting part (6). This can effectively prevent the situation where first electrodes swing and contact second electrodes while an ion pump is in operation. This does not need insulators such as ceramics and can effectively increase vacuum. Namely, a preferred embodiment of the present invention is such that all of or at least more than one of electrode layers existing inside a casing (1) are fixed to the casing (1) or an electrode fixed part such as a flange or a connecting part (6). In order to fix electrode layers, voids for placing electrodes may be provided in a metal constituting a casing (1), for example, into which each electrode may be placed for fixation. Furthermore, in order to maintain the shapes of each electrode layer, a spacer for connecting neighboring electrodes may be provided. Such a spacer fixes electrodes more strongly, which can effectively prevent the situation where electrodes swing and opposed electrodes contact each other while an ion pump system is in operation. A spacer may correspond to the entire electrode fixed part as described above or may be a part thereof.

Magnets (4)

A known magnet used in an ion pump can appropriately be used as a type of magnet. More specifically, a magnet coil or a permanent magnet may be used. Magnets (4) of a preferred embodiment of the first aspect of the present invention are a plurality of cylindrical permanent magnets arranged at intervals in the direction parallel to the central axis—longitudinal direction of the central axis (11)—of a casing (1). Namely, as shown in FIG. 1, outer magnets (4) of this embodiment are a plurality of arranged ring-like permanent magnets. An ion pump system (7) of this mode, instead of using one cylindrical magnet, uses a plurality of cylindrical magnets and arranges them at a predetermined space. This can make an ion pump more lightweight and make it possible to generate a magnetic field effectively. Furthermore, this configuration optimizes a magnetic field arrangement structure caused by the interference effect of magnet groups of an inner pump part and magnets groups of an outer ion pump part and can realize more effective exhaust.

Connecting Part (6)

A connecting part (6) is a part for connecting a casing (1) or an ion pump system (7) of the present invention with other device. "Other device" includes a vacuum chamber, a sample room, or the like for making vacuum state. A specific connecting part (6) is a flange. A connecting part (6) may be a part of the electrode fixed part. Alternatively, the electrode fixed part may double as the function of a connecting part (6).

Ion Pump System (7)

An ion pump system (7) of the present invention comprises a plurality of pump parts inside one chamber (casing (1)). The operating principle of an ion pump is known. Hereinafter, the operating principle of an ion pump is briefly explained. When a voltage of about several kilovolts is applied to and between a cathode and an anode of an ion pump, primary electrons are emitted from a cathode. As primary electrons emitted from a cathode are drawn to an anode and are susceptible to magnetic fields from permanent magnets, they circle following a long spiral path to reach an anode. On the way, primary electrons cause bump into neutral gas molecules and generate many positive ions and secondary electrons. The generated secondary electrons further follow a spiral path, bump into other gas molecules and generate positive ions and electrons. Then, respective ions etc. are adsorbed to electrodes.

An ion pump system (7) of the present invention can appropriately use a known configuration used in an ion pump in addition to the above configuration. For example, a heater, a cooler, or the like may appropriately be attached. Cooling with a cooler can improve the repairing efficiency of gasses. Meanwhile, heating with a heater can maintain a vacuum state to emit the gasses trapped by electrodes.

Hollow Space (30)

The fifth aspect of the ion pump has a hollow space (30) the outside face of which is in a parallel relationship with the central axis (11) of the casing (1). The hollow space has aperture sections on both end sides on the central axis (11). The outside face of the hollow space (30) is fixed based on the inner surface of the first electrode (2*a*) in the fifth aspect of the present invention. The hollow space (30) is uses as a pathway for beam or line of particles that are emitted by electric microscope or electron beam exposure apparatus. When one end of the casing (1) is connected to a vacuum chamber and the other end of the casing (1) is connected to electron beam exposure apparatus, the system make it possible to depict a minute pattern on a wafer in a vacuum chamber keeping law pressure. The hollow space (30) is useful in connecting other cylindrical object of other apparatus and thus it makes it easier to connect other apparatus with the ion pump system (7). The hollow space (30) may be used as a route for supplying fluids (e.g., liquid or gas) to the other apparatus. When inert gas is supplied though the hollow space (30), it is possible to replace gas in other apparatus with inert gas. Further, when cold medium or hot medium is supplied though the hollow space (30) it is possible to control temperature of space in the other apparatus.

The system of the fifth aspect of the present invention comprises casing (1), the first electrode (2*a*), the second electrode (3*a*), and outside magnet (4). As shown in FIGS. 14 and 15, the first electrode (2*a*), the second electrode (3*a*) and outside magnet (4) are arranged in this order.

The fallow space (30) is set inside of the first electrode (2*a*). Namely, the hollow space (30) has the space that comprises the central axis (11) of the casing (1). As shown in FIGS. 14 and 15, this embodiment of the system has axis symmetrical feature. The elements of the ion pump arranged in an axis symmetrical manner with the center axis (11) of the casing (1) being the center. The structure makes the magnetic waves from the first electrode (2*a*), the second electrode (3*a*) and the outside magnet (5) cancel out each other on the central axis (11) of the casing (1). In the space of the hollow space (30), the magnetic waves are cancelled out. Thus, the ion pump system of the fifth aspect of the present invention is able to accommodate such materials or apparatus that are easy to influence on magnetic wave. Materials (particles) that are easy to influence on magnetic wave include but not limited to electrons, protons and charged particles that constitute above described beams or particle lines.

The system is able to save space for trapping ions because it comprises a pair of electrodes (2*a*, 3*a*) in it. FIG. 14 depicts the electric power of alternative current. However, the driving power may be direct current power. Especially, it is possible to use direct power because the voltage applied to a pair of electrode is usually direct voltage.

Preferred embodiment of the fifth aspect of the system comprises a driving means (12). The driving means drives the first electrode (2*a*) and the second electrode (3*a*). The driving means may drive pomp that comprises the first electrode (2*a*) and the second electrode (3*a*).

Preferred embodiment of the fifth aspect of the system is that the outside magnet (4) comprises pluralities of cylindrical permanent magnets arranged in a direction of longitudinal direction of the casing (1) with a space. The embodiment may have any features described above.

The cylindrical permanent magnets make it easy for the system to generate magnetic field efficiently.

Preferred embodiment of the fifth aspect of the system comprises a means for moving (14) that can move the plurality of cylindrical permanent magnets in the longitudinal direction of the cashing (1). The embodiment may have any features described above. The means for moving (14) can change the part where the magnetic field concentrates and thus can change the part where the materials are absorbed. Thus, the system can prevent from losing quality and can improve effectiveness.

The moving mechanism may move magnet from the position where the magnetic field is strong to the place where the magnetic field is not strong. Namely, it moves magnet from the situation before the magnet is moved (4*a*) to the situation after the magnet is moved (4*b*).

If the positions of outside magnets are fixed, the magnet field (21) emulates outside the casing (1) as well as inside the casing (1) as shown in FIG. 6.

When the positions of outside magnets are fixed, magnetic fields gather at the region denoted by element numeral 22 as shown in FIG. 7. Namely, if the ion pump system has fixed outside magnets, getter surfaces gather at specific parts and thus the vacuum effect lessen easily. Further, the gathered getter surfaces may lessen the quality of the system.

By moving the magnets using the means for moving (14), the system can change the area of getter surface as shown in FIG. 8. Thus the system may change the getter surface to new surface which has not lessened its quality of absorbance.

Because the system can make the gas be absorbed to the new surface, it can improve effectiveness of absorption. The example of the means for moving (14) is that it comprises a rail upon which the cylindrical permanent magnets are arranged and the magnets may slide in line with the rail. Any actuator can change the position of magnets by adding power to the magnets. The other example of the means for moving (14) is actuated by hand. Preferred embodiment of the fifth aspect of the system is that it can remove the cylindrical permanent magnets are removable from the casing (1). When the cylindrical permanent magnets are removable, the productivity of the ion pump system is improved and it makes the maintenance be easy.

Preferred embodiment of the fifth aspect of the system is that the polarity of neighboring cylindrical permanent magnets is arranged to be same. The ion pump system (7) of this embodiment may comprise magnetic material (24) among the neighboring magnets. The magnetic material (24) makes the bundle of magnetic fields be arranged to direct to the neighboring surface to the central axis (1) of the casing (11). Because the system has the magnetic material (24) it can arrange the space balance of the bundle of magnetic fields and induce the bundle to enter the direction of the electrodes. The magnetic material (24) may have a function of arranging bundle of magnet. The examples of the magnetic material (24) are permanent magnets, electromagnets, soft iron, iron and ferrite FIG. 9 depicts one example of an ion pump system that uses magnet as the magnetic material (24). The ion pump system (7) of the FIG. 7 is able to strengthen the magnetic field generated inside the casing by having magnets between neighboring outside magnets (4). The feature can make the ion pump system be more effective. The magnetic material (24) may be a cylindrical magnet.

As shown in FIG. 10, the system may comprise magnets between inside surface of the casing (1) and the most outside electrode, e.g., electrode (3). FIG. 10 omits the electrodes other than the most outside electrode to simplify their situation. As shown in FIG. 11, the shape of casing may have confront portions and concave portions such that the system can accommodate magnets within the confront portions and concave portions.

Preferred embodiment of the fifth aspect of the system is that it further comprises cylindrical inner casing (32) and fixed medium (34). Cylindrical inner cashing (32) is set inside of the cashing (1). Cylindrical inner cashing (32) and the cashing (1) are arranged to be concentric circles. The fixed medium (34) is a device that fixes the inner cashing (32), the first electrode (2*a*9, the second electrode (3*a*) and the casing (1) in this order from the centre of the cashing (1) to outside of the cashing. The above hollow space is set inside the inner cashing (32). The inner cashing (32) and the fixed medium may be one unit. The inner flange (36) and the fix medium (34) may be the above electrode fix medium or the connection part (6).

Figure 16:
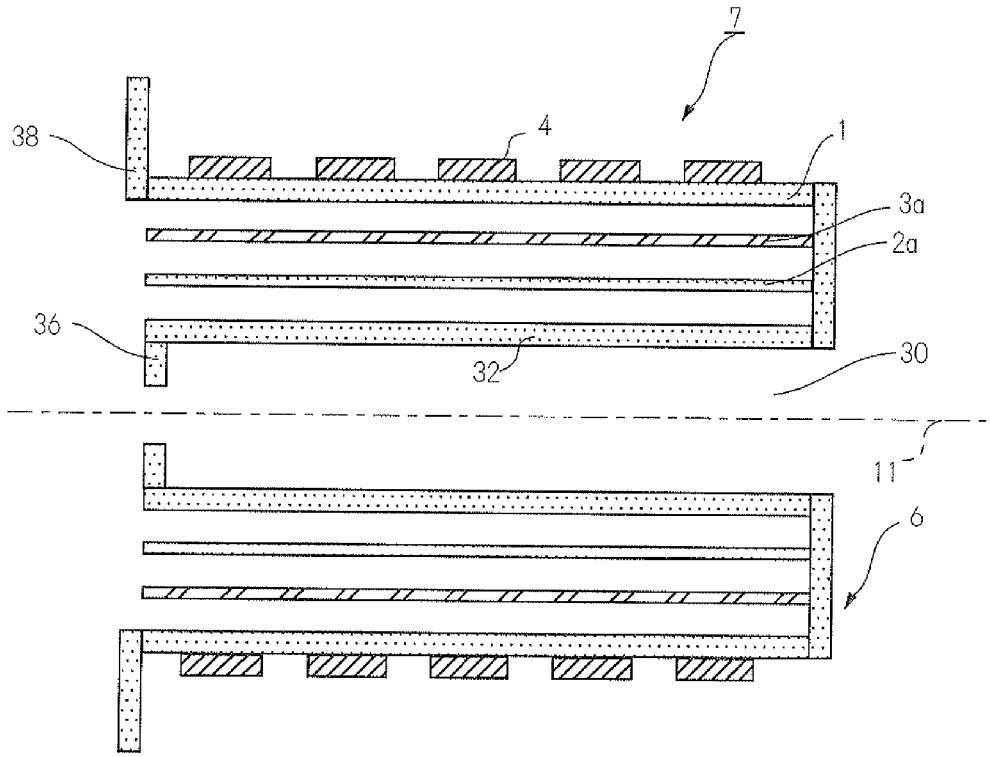
FIG. 16 is a diagram for explaining the case where an ion pump system as shown in FIG. 14 comprises an inner casing and flanges.

Preferred embodiment of the fifth aspect of the system relates to an ion pump system the cashing of which comprises the inner cashing (32) which comprises inner flange (36) as depict in FIG. 16 as above connection part (6). The inner flange (36) thereof is set in opposite site of the above fix medium (34) and fits to the hollow space (30). The inner cashing (32) and the fixed medium may be one unit. The inner flange (36) and the fix medium (34) may be the above electrode fix medium or the connection part (6).

Preferred embodiment of the fifth aspect of the system relates to an ion pump system the cashing of which comprises the outer cashing (38) as depict in FIG. 16 as above connection part (6). The outer flange (38) thereof is directed to the out direction from the outer surface of the cashing (1). The example shown as FIG. 16, the inner flange (36) and the outer flange (38) offset in the direction of the longitudinal axis of the cashing (1). More preferred embodiment is that the amount of offset between the inner flange (36) and the outer flange (38) may be changed based on the apparatus that is connected to the system. The inner flange (36) and the outer flange (38) do not have to have any offsets. Both of the inner flange (36) and the outer flange (38) may constitute one unit with the fix medium (34). The inner cashing (32) and the fixed medium may be one unit. The inner flange (36) and the fix medium (34) may be the above electrode fix medium or the connection part (6).

Figure 17:
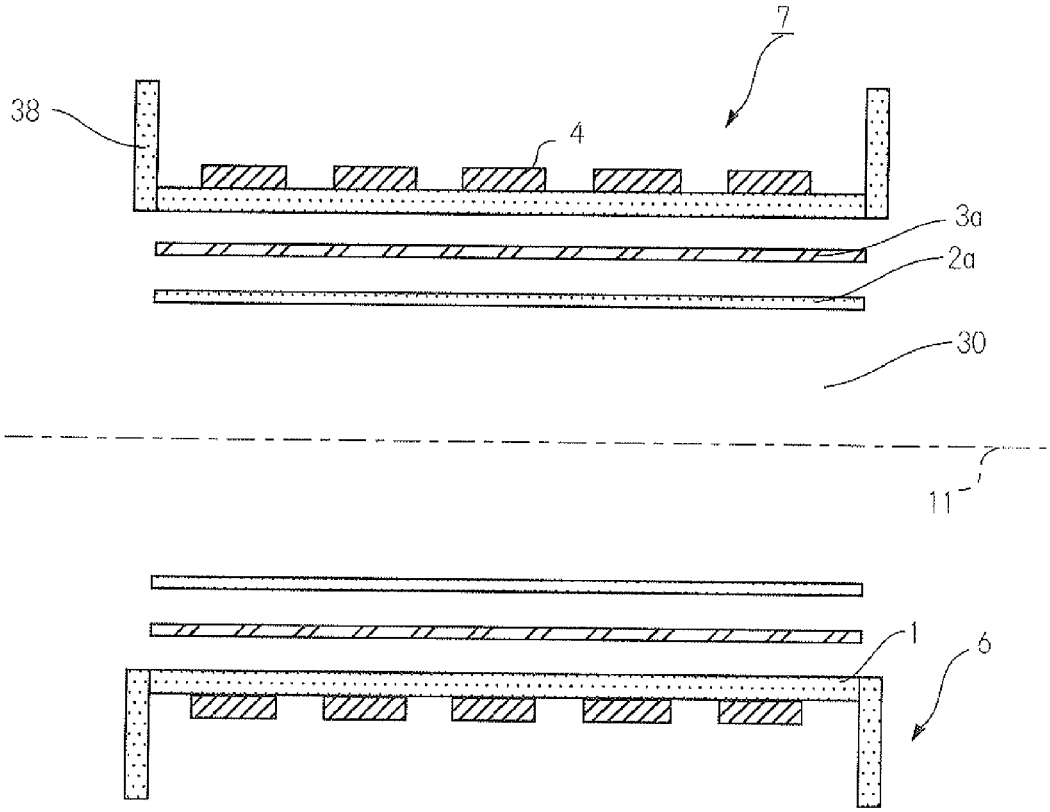
FIG. 17 is a diagram for explaining the case where an ion pump system as shown in FIG. 14 is provided with flanges at each end.

The flange mentioned the above, the outer flange (38) may be set at both side on the ion pump as depict in FIG. 17. The system may have the above mentioned inner flange (36) and outer flange (38) as shown in FIG. 16 and does not have to have these flanges as shown in FIG. 17.

Figure 18:
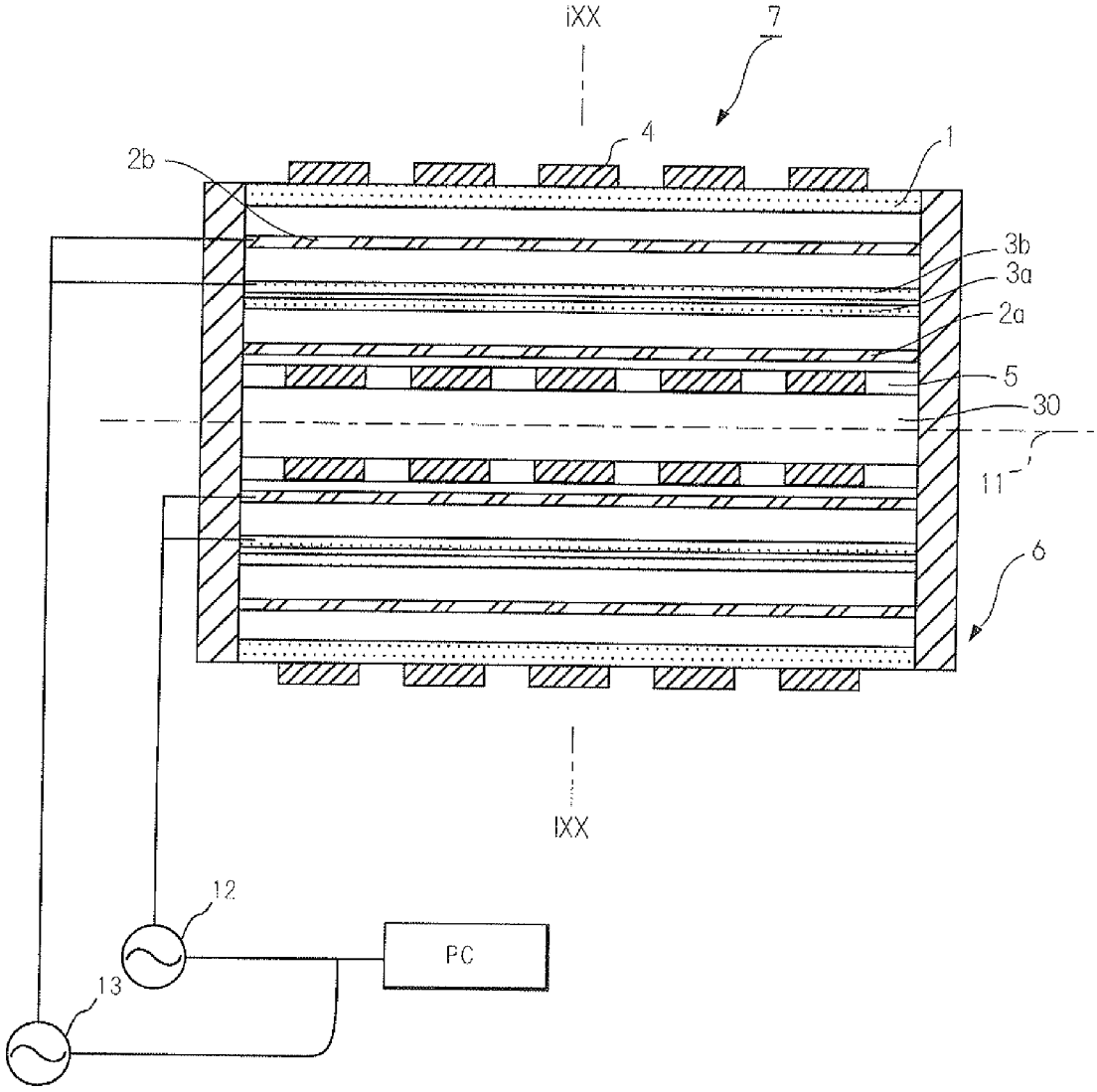
FIG. 18 is a diagram for explaining an ion pump system according to the sixth aspect of the present invention.
Figure 19:
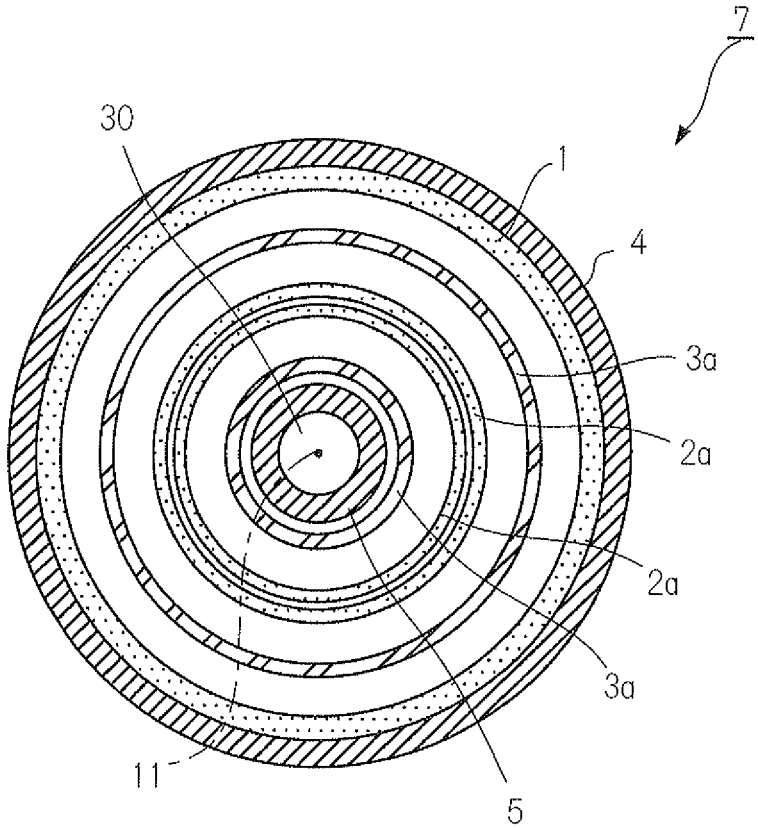
FIG. 19 is a cross-section view along line IXX-IXX of FIG. 18.

FIG. 18 is a schematic figure to show the ion pump system of the sixth aspect of the present invention. FIG. 19 is a cross sectional diagram of the ion pump system of FIG. 18. The ion pump system (7) of the sixth aspect of the present invention relates to a system that has two pump parts within one chamber. Namely, the ion pump system (7) of the sixth aspect of the present invention adds a pair of electrodes and magnets to the ion pump system (7) of the fifth aspect of the present invention. These additional elements are also in a condition of centrifugal condition.

More specifically, the added pair of electrodes is set between the first electrode (2*a*) and the cashing (1) as shown in FIG. 18. The pair of electrodes comprises the third electrode (2*b*) and the fourth electrode (3*b*) and the polarity of these electrodes are opposite. The third electrode (2*b*), which is set between the first electrode (2*a*) and the cashing (1), has the same polarity with the first electrode (2*a*). The fourth electrode (3*b*), which is set between the third electrode (2*b*) and the second electrode (3*a*), has the same polarity with the second electrode (3*a*). The added magnets are inner magnets that are set inside of the inner surface of the first electrode (2*a*). The added magnets are configured to be in parallel relationship with the outer magnets. The example of the inner magnet is cylindrical one.

The added magnets may be inner magnets (5) as shown in FIG. 18. These magnets may be configured to be in parallel relationship with the outer magnets (4). When the ion pump system (7) has two pairs of electrodes, it is able to optimize the alignment of magnetic field caused by the interference among the group of magnets of inner pump and the group of magnets of out pump. Then it can realize differentiate extinguishment efficiently and can attain high vacuum.

The sixth aspect of the ion pump system (7) also has a hollow space in line with the central axis (11) of the cashing (1). The technical effect of the hollow space is the same as explained above.

Preferred embodiment of the sixth aspect of the system relates to an ion pump system that second electrode (2*a*) and the fourth electrode (3*b*) are the inner surface and the outer surface of one cylindrical electrode, respectively. Using one cylindrical electrode for two electrodes that have the same polarity make is possible to save space and enable the system to be compact.

Figure 20:
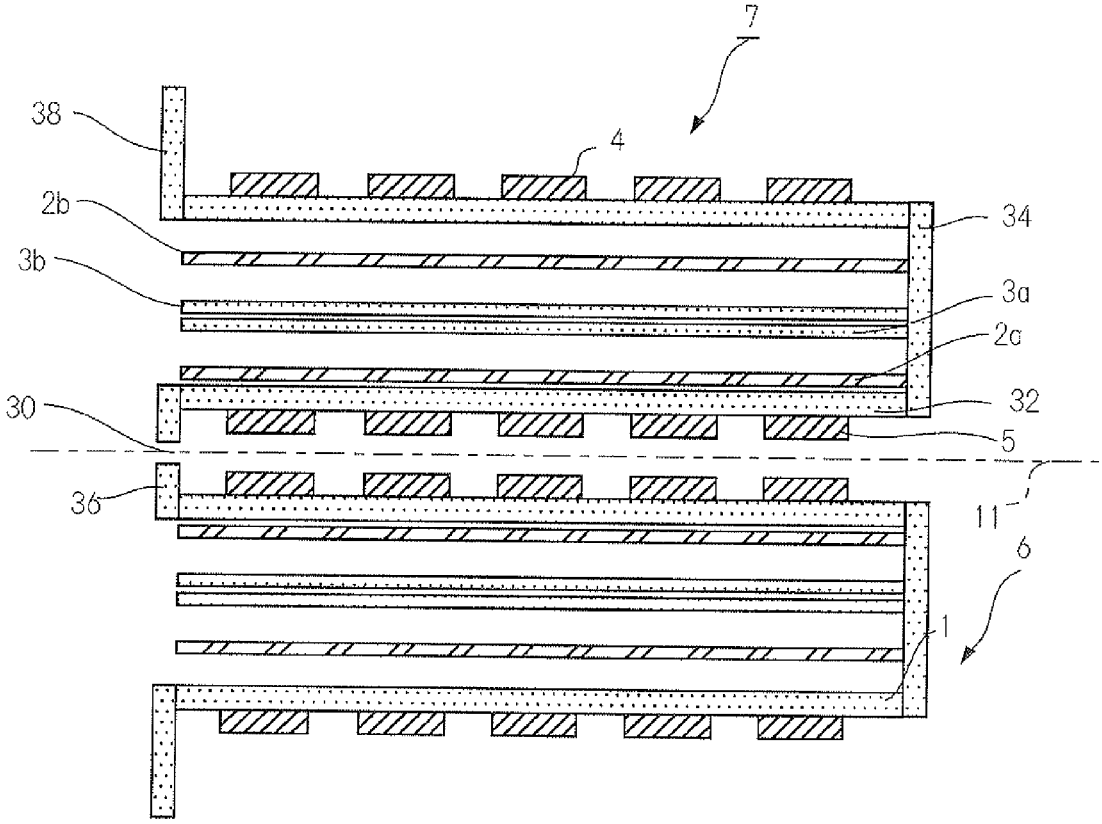
FIG. 20 is a diagram for explaining the case where an ion pump system as shown in FIG. 18 comprises an inner casing and flanges.
Figure 21:
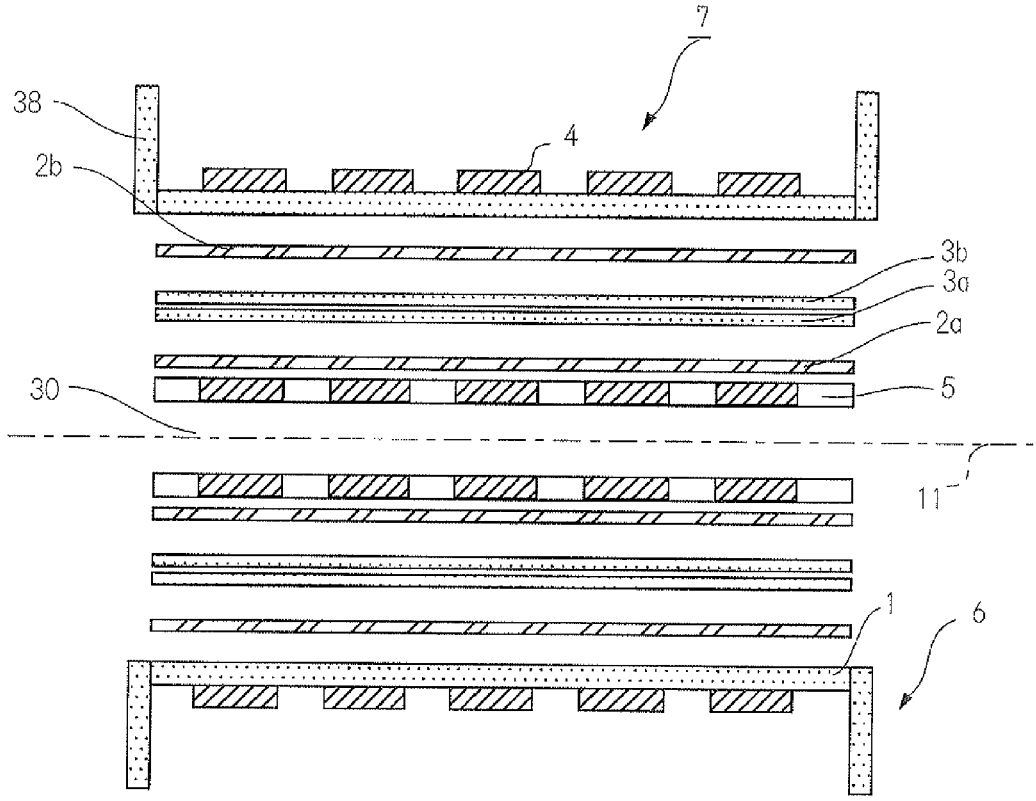
FIG. 21 is a diagram for explaining the case where an ion pump system as shown in FIG. 18 is provided with flanges at each end.

Preferred embodiment of the sixth aspect of the system relates to an ion pump system that has inner cashing (32) that is configured to be within the outer cashing (1). For this type of system, the inner surface of the inner cashing (32) acts as a part of outer surface of the hollow space (30). The inner surface of the inner cashing (32) depict in FIG. 20 includes the surface of inner magnets (5). The inner surface of the first electrode (2*a*) may form a part of the outer surface of the hollow space (30) as shown in FIG. 21. The holding apparatus, which holds inner magnets (5), of FIG. 21 has holes or slits.

As explained above, the fifth aspect and the sixth aspect of the present invention further comprise the hollow space (30) along with the central axis of the cashing and have meritorious effect that they can obtain spaces that are less influenced with the magnetic fields. Furthermore, these systems can obtain such spaces without magnetic shields and thus it can save cost. These systems can handle beams or molecular lines that have such particles that are easily influenced by magnetic fields.

Next, the other aspect of the present invention is explained as the seventh aspect. The above embodiment of the ion pump system uses the space composed by the pair of electrodes as less pressure area of the pump and it captures molecules that pass through the space by ionizing the molecules by means of electrodes. The seventh aspect uses the hollow space (30) as pathway for fluids, including gas and liquid, and makes the fluids into the space between a pair of electrodes and make the fluids experience with the magnetic field. The seventh aspect relates to an apparatus to generate magnetic fields. The seventh aspect may be a pump but it does not required to be a pump.

The fundamental structure of the seventh aspect of the ion pump system is the same as that of fifth aspect and that of sixth aspect. Thus the figures of the system are not shown. When used as an apparatus to generate magnetic fields, the system of the seventh aspect has an aperture or apertures at least on materials that compose pathway, e.g., on the first electrode (2*a*) or the inner cashing (32), such that the fluids are induced into the pathway.

The fluids are induced from the pathway to the space between the pair of electrodes of the apparatus to generate magnetic fields. Magnetic fields have influence with the fluids that pass the space between the pair of electrodes. The molecules that constitute the fluids become ions by the electronic magnetic energy from the magnetic fields (activated and the molecules emit electrons). Ionized molecules are absorbed by the electrodes that have opposite polarity. In some case such molecules accumulate at the electrodes. Fluids may be gas, liquid or the mixture thereof. Not only molecules but also atoms or electrons may compose the liquid.

The magnetic generator of the seventh aspect can induce the fluid, including gas and liquid, into the space between the pair of electrodes continuously using the hollow space (30) as a pathway. The pathway is configured to be along with the central axis (11) of the cashing (1) and thus the fluids that pass the pathway do not influenced on the magnetic field strongly. Further the fluids are introduced into the space between the pair of electrodes and thus the fluids do not influenced by the magnetic fields.

The inner surface of the first electrode (2*a*) forms the pathway for the system depicted in FIG. 18. In this case, the pathway and the first electrode (2*a*) form inner surface and outer surface of one cylindrical object. When an apparatus of electromagnetic generator comprising inner cashing (32) as depicted in FIGS. 16 and 20, the pathway is formed by inner surface of the inner cashing, which comprises surface of inner magnets. In this case, the pathway and the inner cashing (32) may be inner surface and outer surface of one cylindrical object.

When the electromagnetic generator comprises two pairs of electrodes as shown in FIGS. 20 and 21, the space between one pair of electrodes that is close to the pathway, a hollow body (30) may act as the first trap area and the space that is not close one may act as the second trap area. The system may comprise the door that can be opened and be closed; the door is nod depict in the figure. When the door is open, each trap areas capture molecules that constitute fluids, including gas and liquid, which are introduced from the pathway. Namely the door makes it possible to clean the fluids in two steps. On the other hand, when the system does not have the door or when the door is closed, the system can separate each space. The separated spaces make it possible to clean each space independently and to execute any treatment, e.g., electric discharge and activation of fluids, independently.

The above described electromagnetic generator may add pressure to fluids or lessen the pressure of the fluids so that it controls the direction of fluids that pass through the pathway and the space between the pair of electrodes. Furthermore, the apparatus may comprise pathways to control the direction of fluids.

The above described electromagnetic generator may handle liquids as well as gas. It is preferred that the apparatus may comprise above described inner flanges or outer flanges so that the apparatus can connect other devices and can prevent fluids from emulating from the apparatus. The examples of the fluids are liquid in which molecular clusters are dissolved. Such fluids may not be influenced by electromagnetic waves during passing the pathways. Further, the clusters in the fluids may be dissolved by the electromagnetic energy after introduced in the space between a pair of electrodes. The space between the pair of electrodes may act as another pathway. Considering the fact, the above described electromagnetic generator has two or more pathways. The apparatus may act as supplier of two or more kinds of fluids by controlling the amount or ratio of the fluids that pass two or more kinds of pathways, even though the apparatus is not limited to act such an apparatus.

INDUSTRIAL APPLICABILITY

An ion pump system of the present invention can be used in the vacuum device industry or in the field of substance activation. Furthermore, an electromagnetic generator of the present invention can be used in the field of substance activation.

The invention claimed is:

1. An ion pump system which comprises a casing, a first electrode group which is configured to be in the casing, a second electrode group which is configured to be in the casing, outer magnets which produce a magnetic field inside the casing, and inner magnets which are configured to be in the casing, wherein the casing comprises one or pluralities of connecting parts which connect the ion pump system with other apparatus, the first electrode group and the second electrode group have different polarity, the casing, the first electrode group, the second electrode group and the inner magnets are configured to be arranged in the following order from the central part of the casing to outside part of the casing:

the inner magnets which are along a central axis of the casing or are configured to be arranged symmetrically with respect to the central axis;

a first electrode of the first electrode group, the first electrode being at the innermost of the first electrode group;

a first electrode of the second electrode group, the first electrode being at the innermost of the second electrode group;

a second electrode of the second electrode group, the second electrode being at the second innermost of the second electrode group;

a second electrode of the first electrode group, the second electrode being at the second innermost of the first electrode group; and the outer magnets.

2. The ion pump system in accordance with claim 1, further comprises:

a first drive means and a second drive means, wherein the first drive means drives a first pump part which comprises the first electrode of the first electrode group and the first electrode of the second electrode group, the second drive means drives a second pump part which comprises the second electrode of the second electrode group, the second electrode of the first electrode group and the outer magnets, thereby the ion pump system can drive the first pump part and the second pump part independently by driving the first drive means and the second drive means independently.

3. The ion pump system in accordance with claim 2, wherein the first electrode of the second electrode group and the second electrode of the second electrode group are an inner surface of a cylindrical electrode and an outer surface of the cylindrical electrode, respectively.

4. The ion pump system in accordance with claim 2, wherein the outer magnets comprise a plurality of cylindrical permanent magnets arranged at intervals in the longitudinal direction of the casing.

5. The ion pump system in accordance with claim 4, further comprises a movement device for moving the pluralities of cylindrical permanent magnets toward the longitudinal direction of the casing.

6. The ion pump system in accordance with claim 5, wherein the cylindrical permanent magnets are removable from the casing.

7. The ion pump system in accordance with claim 4, wherein each of the pluralities of cylindrical permanent magnets are configured to have the same polarity with its neighboring cylindrical permanent magnet.

8. The ion pump system in accordance with claim 7, further comprises magnetic materials between each of the neighboring magnets of the pluralities of cylindrical permanent magnets, wherein each of the magnetic material is configured to arrange the direction of the flux that is from the neighboring surface of the magnet to the central axis of the casing.

9. The ion pump system in accordance with claim 1, wherein the casing, the first electrode group, the second electrode group and the inner magnets configured to be arranged in the following order from the central part of the casing to outside part of the casing:

the inner magnets which are along the central axis of the casing or are configured to be arranged symmetrically with respect to the central axis;

the first electrode of the first electrode group, the first electrode being at the innermost of the first electrode group;

the first electrode of the second electrode group, the first electrode being at the innermost of the second electrode group;

the second electrode of the second electrode group, the second electrode being the second innermost of the second electrode group;

the second electrode of the first electrode group, the second electrode being the second innermost of the first electrode group;

a cylindrical inner magnet;

a third electrode of the first electrode group, the third electrode being the third innermost of the first electrode group;

a third electrode of the second electrode group, the third electrode being the third innermost of the second electrode group; and the outer magnets.

10. The ion pump system in accordance with claim 9, further comprises:

a first drive means, a second drive means and a third drive means, wherein the first drive means drives a first pump part which comprises the first electrode of the first electrode group and the first electrode of the second electrode group, the second drive means drives a second pump part which comprises the second electrode of the second electrode group and the second electrode of the first electrode group, the third drive means drives a third pump part which comprises the third electrode of the first electrode group and the third electrode of the second electrode group and the outer magnets, thereby the ion pump system can drive the first pump part, the second pump part and the third pump part independently by driving the first drive means, the second drive means and the third drive means independently.

11. The ion pump system in accordance with claim 1, wherein the casing, the first electrode group, the second electrode group and the inner magnets are configured to be arranged in the following order from the central part of the casing to outside part of the casing:

the inner magnets which are along the central axis of the casing or are configured to be arranged symmetrically with respect to the central axis;

the first electrode of the first electrode group, the first electrode being at the innermost of the first electrode group;

the first electrode of the second electrode group, the first electrode being at the innermost of the second electrode group;

the second electrode of the second electrode group, the second electrode being the second innermost of the second electrode group;

the second electrode of the first electrode group, the second electrode being the second innermost of the first electrode group;

a cylindrical inner magnet;

a third electrode of the first electrode group, the third electrode being the third innermost of the first electrode group;

a third electrode of the second electrode group, the third electrode being the third innermost of the second electrode group;

a fourth electrode of the second electrode group, the fourth electrode being the fourth innermost of the second electrode group;

a fourth electrode of the first electrode group, the fourth electrode being the fourth innermost of the first electrode group; and the outer magnets, wherein the ion pump system further comprises:

a first drive means, a second drive means, a third drive means, and a fourth drive means, wherein the first drive means drives a first pump part which comprises the first electrode of the first electrode group and the first electrode of the second electrode group, the second drive means drives a second pump part which comprises the second electrode of the second electrode group and the second electrode of the first electrode group, the third drive means drives a third pump part which comprises the third electrode of the first electrode group and the third electrode of the second electrode group, the fourth drive means drives a fourth pump part which comprises the fourth electrode of the first electrode group, the fourth electrode of the second electrode group and the outer magnets, thereby the ion pump system can drive the first pump part, the second pump part, the third pump part and the fourth pump part independently by driving the first drive means, the second drive means, the third drive means and the fourth drive means independently.

* * * * *